US010867590B1

(12) United States Patent
Miller et al.

(10) Patent No.: US 10,867,590 B1
(45) Date of Patent: Dec. 15, 2020

(54) MODULAR INLINE PEDAL SYSTEM AND METHODS FOR USING THE SAME

(71) Applicant: Modular Pedal Systems Inc., Brooklyn, NY (US)

(72) Inventors: Daniel Miller, Brooklyn, NY (US); Joe Transue, Hartford, CT (US); Scott Bozack, Salem, VA (US)

(73) Assignee: Modular Pedal Systems Inc., Brooklyn, NY (US)

( * ) Notice: Subject to any disclaimer, the term of this patent is extended or adjusted under 35 U.S.C. 154(b) by 311 days.

(21) Appl. No.: 15/997,449

(22) Filed: Jun. 4, 2018

Related U.S. Application Data

(60) Provisional application No. 62/514,435, filed on Jun. 2, 2017.

(51) Int. Cl.
*G10H 1/34* (2006.01)
*G10H 1/00* (2006.01)

(52) U.S. Cl.
CPC ..... *G10H 1/348* (2013.01); *G10H 1/0008* (2013.01)

(58) Field of Classification Search
CPC ..... G10H 1/348; G10H 1/0008
USPC ..... 84/746, 721
See application file for complete search history.

(56) References Cited

U.S. PATENT DOCUMENTS 6,376,761 B1 * 4/2002 Lamarra ..... G10H 1/02 381/118
7,005,571 B1 * 2/2006 Groff ..... G10H 1/0066 84/615
7,326,849 B2 * 2/2008 Adams ..... G10H 1/0066 84/743
7,678,985 B2 * 3/2010 Adams ..... G10H 1/0066 84/645
7,711,442 B2 * 5/2010 Ryle ..... G10H 1/0091 700/94
8,614,385 B2 * 12/2013 McKinney ..... G10H 1/348 84/453
9,348,365 B2 * 5/2016 Gillis ..... G06F 1/1656
9,800,357 B2 * 10/2017 Tillman ..... H04H 60/05
9,947,302 B2 * 4/2018 Canivell Grifols ..... G10G 5/00
(Continued)

FOREIGN PATENT DOCUMENTS

GB 2569779 A * 7/2019 ..... G10H 1/057

*Primary Examiner* — David S Warren
(74) *Attorney, Agent, or Firm* — Byrne Poh LLP

(57) ABSTRACT

A modular inline pedal system and methods for using the same are provided. In some embodiments, an apparatus for a musical instrument is provided, the apparatus comprising: a pedalboard that receives an audio signal and that routes the audio signal through one or more instrument pedals such that the audio signal is modified based on one or more instrument effects from the one or more instrument pedals, wherein a top surface of the pedalboard includes: a plurality of pedal attachment regions that receives the one or more instrument pedals, wherein each of the plurality of pedal attachment regions includes an adjustable slider that adjust to accommodate placement of an instrument pedal of differing dimensions, wherein the adjustable slider exposes a mating pin connector for connecting with a plurality of pins positioned on a rear surface of the instrument pedal, and wherein a communication channel between the instrument pedal and the pedalboard is created via a connection of the mating pin connector with the plurality of pins.

19 Claims, 23 Drawing Sheets

(56) References Cited

U.S. PATENT DOCUMENTS 10,008,192 B2 * 6/2018 Kreifeldt ..... G10G 5/00
10,127,899 B2 * 11/2018 Perez ..... G10H 1/0058
10,163,430 B2 * 12/2018 Jashyn ..... G10H 1/348
10,192,536 B1 * 1/2019 Jia ..... G10H 1/0008
10,380,984 B1 * 8/2019 Calder ..... G10H 1/32
10,395,631 B1 * 8/2019 Boxberger ..... G10H 1/0555
10,565,971 B2 * 2/2020 Wilfer ..... G10H 1/348
10,621,964 B1 * 4/2020 Boxberger ..... G10H 1/348
10,636,401 B2 * 4/2020 Leff ..... G10H 1/0091
10,657,940 B1 * 5/2020 Calder ..... G10H 1/0008
10,706,828 B2 * 7/2020 Christian ..... G06F 1/263
2003/0066410 A1 * 4/2003 Stratton ..... G10H 1/348
84/422.1
2007/0245886 A1 * 10/2007 Adams ..... G10H 1/0066
84/745
2011/0271821 A1 * 11/2011 McKinney ..... G10H 1/348
84/746
2015/0138703 A1 * 5/2015 Gillis ..... G06F 1/1656
361/679.04
2015/0161978 A1 * 6/2015 Packouz ..... G10H 1/40
84/746
2016/0044761 A1 * 2/2016 Ahern ..... G10H 1/00
315/294
2016/0139660 A1 * 5/2016 Chu ..... G06F 3/002
345/156
2016/0301488 A1 * 10/2016 Tillman ..... H04H 60/04
2017/0140744 A1 * 5/2017 Kreifeldt ..... G10H 1/348
2017/0206879 A1 * 7/2017 Fiden ..... G10H 1/348
2017/0316766 A1 * 11/2017 Perez ..... G10H 1/0091
2017/0324494 A1 * 11/2017 Tillman ..... H04H 60/04
2018/0046244 A1 * 2/2018 Chu ..... G06F 3/0338
2018/0144731 A1 * 5/2018 McHale ..... G10H 1/18
2018/0151162 A1 * 5/2018 McKenzie ..... G10H 1/348
2018/0166837 A1 * 6/2018 Schmidt ..... G10H 1/0033
2018/0197512 A1 * 7/2018 Perez ..... G10H 1/043
2018/0204555 A1 * 7/2018 Garcia ..... G10H 1/348
2018/0301131 A1 * 10/2018 Jashyn ..... G10H 1/348
2018/0330706 A1 * 11/2018 Leff ..... G10H 3/186
2019/0103086 A1 * 4/2019 Christian ..... G06F 1/263
2019/0237053 A1 * 8/2019 Canivell Grifols ..... G10H 1/32
2020/0027433 A1 * 1/2020 Wilfer ..... G10G 5/00
2020/0126528 A1 * 4/2020 Packouz ..... G10H 1/0066
2020/0202828 A1 * 6/2020 Scherbacovsky .... G10H 1/0066

* cited by examiner

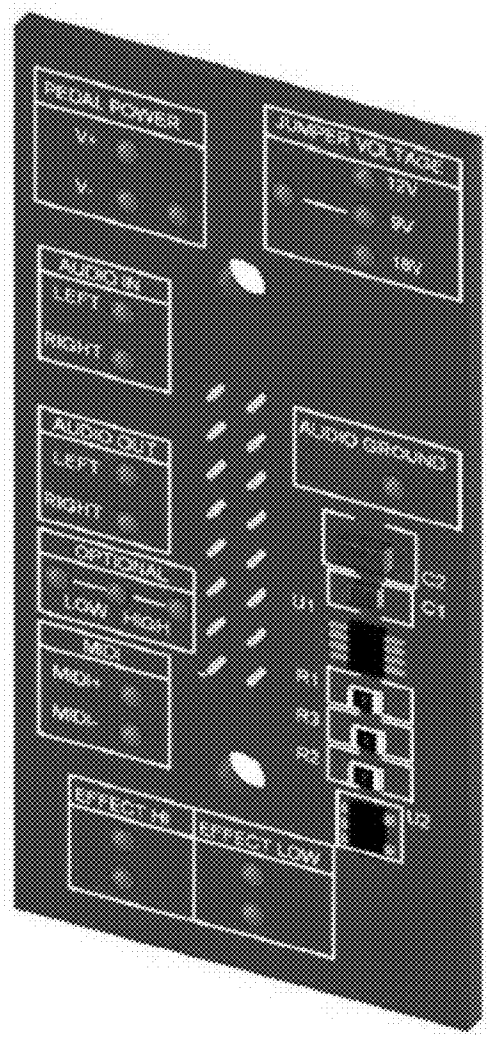
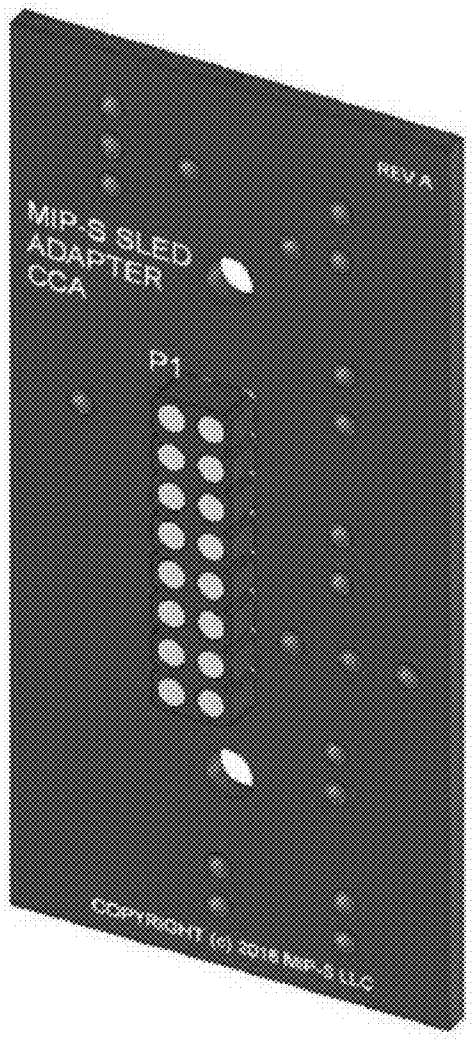
FIG. 8

Chassis
Channel Level
Channel Level
Channel Level

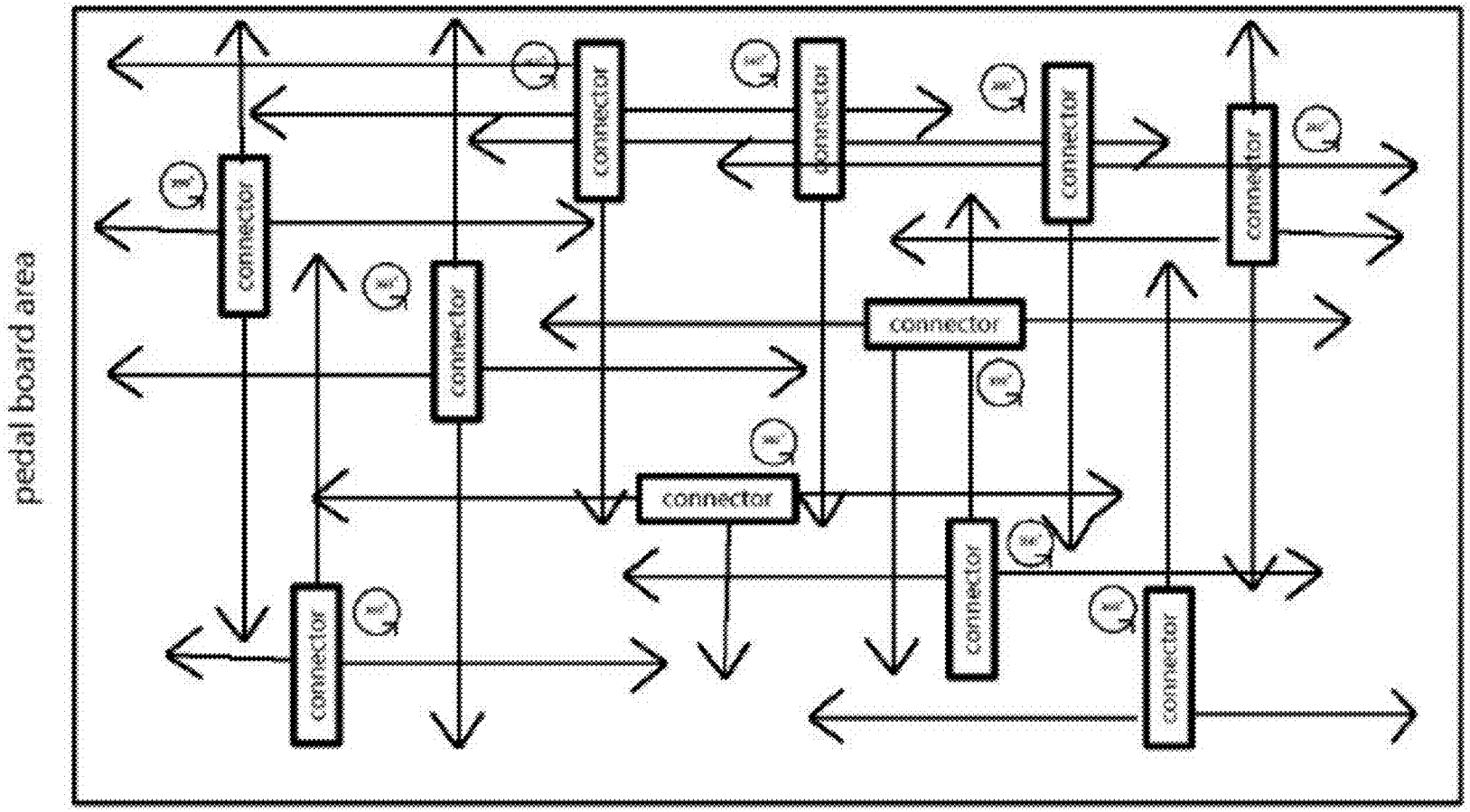
connector
connector
connector

MODULAR INLINE PEDAL SYSTEM AND METHODS FOR USING THE SAME

CROSS-REFERENCE TO RELATED APPLICATIONS

This application claims the benefit of U.S. Provisional Patent Application No. 62/514,435, filed on Jun. 2, 2017, which is hereby incorporated by reference herein in its entirety.

TECHNICAL FIELD

The disclosed subject matter relates to a modular inline pedal system and methods for using the same.

BACKGROUND

For many instrumentalists and audio engineers, guitar pedals contribute to a large part of their sound. Each of these guitar pedals can be designed to provide one or many effects in a wide sonic palette of effects that includes, for example, a particular distortion, a particular chorus, a particular compressor, a particular delay, etc. That is, the tones and audio manipulations that these guitar pedals can create are used to add color to their sound.

Moreover, many instrumentalists are passionate collectors and users of these guitar pedals. Guitar pedals are typically encased in metal pedal boxes that can sit on the floor in front of the instrumentalist. In such instances, each guitar pedal in a pedal box can be selectively turned on and off via a switch proximal to the foot of the instrumentalist. For example, an instrumentalist can selectively turn on or off a guitar pedal depending on whether a desired effect caused by that guitar pedal is needed.

In addition, guitar pedals can be connected together using instrument cables, where the pedals are powered by a separate power cable connected to a power source or a battery. In the instance where the instrumentalist uses multiple guitar pedals at the same time, these pedals are often mounted onto a pedalboard, which serves as a platform for organizing and using these pedals together. For example, an instrumentalist can use a pedalboard to organize various guitar pedals and use each pedal one at a time. In another example, an instrumentalist can combine different effects by activating multiple pedals at the same time. It should be noted that guitar pedals are typically mounted to the pedalboard by hook-and-loop fasteners attached to the bottom of a guitar pedal and the surface of the pedalboard. Alternatively, in some pedalboards, each guitar pedal can be screwed into place on the pedalboard.

Note that, if the instrumentalist desires additional connectivity and functionality from the guitar pedals, additional hardware, additional cables, and/or additional power connections are generally required. For example, the instrumentalist can desire additional connectivity such that the instrumentalist can selectively turn on and off particular guitar pedals at the same time using a different controller that simultaneously sends signals to multiple guitar pedals. Because of the number of guitar pedals, the complex configurations, and the desire of instrumentalists to have greater flexibility, typical pedalboards become a complex maze of wires, routers, power cables, patch cords, etc. Moreover, each of these elements create an unstable and unpredictable state in which any of these elements can fail. For example, typical pedalboards include cabled connections between each of the guitar pedals, where these musical and power connections are prone to breaking, most often at the point of connection (e.g., repeated pulling out and reseating cables causes stress on the cables that eventually leads to failure). In the instance that the cable or pedal breaks, the entire audio signal is either blocked or corrupted, thereby leading to a complicated and inexact diagnosis of where the problematic element or elements occur. As such, each element is tested and each guitar pedal is isolated in the analysis to find the source of the issue.

Accordingly, it is desirable to provide a modular inline pedal system that overcomes these and other deficiencies of the prior art.

SUMMARY

A modular inline pedal system and methods for using the same are provided.

In accordance with some embodiments of the disclosed subject matter, an apparatus for a musical instrument, the apparatus comprising: a pedalboard that receives an audio signal and that routes the audio signal through one or more instrument pedals such that the audio signal is modified based on one or more instrument effects from the one or more instrument pedals, wherein a top surface of the pedalboard includes: a plurality of pedal attachment regions that receives the one or more instrument pedals, wherein each of the plurality of pedal attachment regions includes an adjustable slider that adjust to accommodate placement of an instrument pedal of differing dimensions, wherein the adjustable slider exposes a mating pin connector for connecting with a plurality of pins positioned on a rear surface of the instrument pedal, and wherein a communication channel between the instrument pedal and the pedalboard is created via a connection of the mating pin connector with the plurality of pins.

In some embodiments, the audio signal is received from a musical instrument.

In some embodiments, the mating pin connector is a spring-loaded connector.

In some embodiments, the apparatus further comprises a power supply, wherein a first instrument pedal is connected to the pedalboard at a first pedal attachment region of the plurality of pedal attachment regions and a second instrument pedal is connected to the pedalboard at a second pedal attachment region of the plurality of pedal attachment regions, and wherein a first voltage from the power supply is provided to the first instrument pedal using a first group of the plurality of pins associated with the first instrument pedal and a second voltage from the power supply that is different than the first voltage is provided to the second instrument pedal using a second group of the plurality of pins associated with the second instrument pedal.

In some embodiments, an instrument pedal of the one or more instrument pedals is configured to be in one of an active configuration or a bypass configuration, wherein the audio signal passes through and is modified by the instrument pedal when the instrument pedal is in the active configuration, and wherein the audio signal does not pass through the instrument pedal when the instrument pedal is in the bypass configuration and remains in the pedalboard.

In some embodiments, the apparatus further comprises a plurality of light indicators, each light indicator of the plurality of light indicators corresponding to an instrument pedal of the one or more instrument pedals, wherein each light indicator indicates a status of a corresponding instrument pedal.

In some embodiments, the apparatus further comprises a foot controller, wherein the foot controller is configured to change a configuration of a plurality of the one or more instrument pedals via circuitry in the pedalboard.

In some embodiments, a portion of each of the plurality of pedal attachment regions is rotatable into a plurality of positions.

In some embodiments, the apparatus further comprises a wireless communications adapter that opens the communication channel with an external device for transmitting information between the pedalboard apparatus and the external device over a wireless communications network.

In some embodiments, the pedalboard apparatus receives a user input via the external device and transmits a signal corresponding to the user input to an instrument pedal of the one or more instrument pedals via the communication channel.

In some embodiments, the pedalboard apparatus determines information associated with the instrument pedal via the communication channel and transmits the determined information to the external device.

In some embodiments, the apparatus further comprises an adaptor that is configured to be attached to the pedalboard at a pedal attachment region of the plurality of pedal attachment regions at a first side of the adaptor, wherein the adaptor is configured to be attached to a second instrument pedal, wherein the second instrument pedal cannot be connected to the pedalboard at any of the plurality of pedal attachment regions, and wherein the adaptor is configured to accept one or more cables connected to corresponding jacks of the second instrument pedal.

In accordance with some embodiments of the disclosed subject matter, a pedalboard for a musical instrument is provided, the pedalboard comprising: a hardware processor; and a plurality of pedal attachment regions connected to the hardware processor, wherein each of the plurality of pedal attachment regions receives an instrument pedal, wherein each of the plurality of pedal attachment regions includes an adjustable slider that adjust to accommodate the instrument pedal of differing dimensions, wherein the adjustable slider exposes a mating pin connector for connecting with a plurality of pins positioned on a surface of the instrument pedal, and wherein a communication channel between the instrument pedal and the hardware processor is created via a connection of the pin connector with the plurality of pins; wherein the hardware processor is configured to receive an audio signal from the musical instrument and route the audio signal through the instrument pedal such that the audio signal is modified based on one or more instrument effects from the instrument pedal.

In some embodiments, the mating pin connector is a spring-loaded connector.

In some embodiments, the pedalboard further comprises a power supply, wherein a first instrument pedal is connected to the pedalboard at a first pedal attachment region of the plurality of pedal attachment regions and a second instrument pedal is connected to the pedalboard at a second pedal attachment region of the plurality of pedal attachment regions, and wherein a first voltage from the power supply is provided to the first instrument pedal using a first group of the plurality of pins associated with the first instrument pedal and a second voltage from the power supply that is different than the first voltage is provided to the second instrument pedal using a second group of the plurality of pins associated with the second instrument pedal.

In some embodiments, the instrument pedal of the one or more instrument pedals is configured to be in one of an active configuration or a bypass configuration, wherein the audio signal passes through and is modified by the instrument pedal when the instrument pedal is in the active configuration, and wherein the audio signal does not pass through the instrument pedal when the instrument pedal is in the bypass configuration and remains in the pedalboard.

In some embodiments, the pedalboard further comprises a plurality of light indicators, each light indicator of the plurality of light indicators corresponding to an instrument pedal of the one or more instrument pedals, wherein each light indicator indicates a status of a corresponding instrument pedal.

In some embodiments, the pedalboard further comprises a foot controller, wherein the foot controller is configured to change a configuration of a plurality of the one or more instrument pedals via circuitry in the pedalboard.

In some embodiments, a portion of each of the plurality of pedal attachment regions is rotatable into a plurality of positions.

In some embodiments, the pedalboard further comprises a wireless communications adapter that opens the communication channel with an external device for transmitting information between the pedalboard apparatus and the external device over a wireless communications network.

In some embodiments, the hardware processor is further configured to receive a user input via the external device and transmit a signal corresponding to the user input to the instrument pedal of the one or more instrument pedals via the communication channel.

In some embodiments, the hardware processor is further configured to determine information associated with the instrument pedal via the communication channel and transmit the determined information to the external device.

In some embodiments, the pedalboard further comprises an adaptor that is configured to be attached to the pedalboard at a pedal attachment region of the plurality of pedal attachment regions at a first side of the adaptor, wherein the adaptor is configured to be attached to a second instrument pedal, wherein the second instrument pedal cannot be connected to the pedalboard at any of the plurality of pedal attachment regions, and wherein the adaptor is configured to accept one or more cables connected to corresponding jacks of the second instrument pedal.

In accordance with some embodiments of the disclosed subject matter, an instrument pedal for modifying an audio signal received from a musical instrument is provided, the instrument pedal comprising: a housing; a plurality of pins positioned on a rear surface of the housing, wherein the plurality of pins connect with a mating pin connector positioned with a pedal attachment region of a plurality of pedal attachment regions on a pedalboard and wherein a communication channel between the instrument pedal and the pedalboard is created via a connection of the plurality of pins with the mating pin connector; and one or more magnetic elements positioned on the rear surface of the housing, wherein the one or more magnetic elements cause the instrument pedal to be aligned and removably attached to the pedal attachment region of the plurality of pedal attachment regions on the pedalboard and wherein the one or more magnetic elements cause the plurality of pins to mate with the mating pin connector.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

FIG. 8 shows an illustrative circuit board that can be included at a pedal attachment region of the pedalboard apparatus in which the circuit board includes a multi-pin connector for receiving the pins on the rear portion of an instrument pedal in accordance with some embodiments of the disclosed subject matter.

FIGS. 19A and 19B show illustrative examples of flexible connectors for connecting pedals to pedal boards in different configurations in accordance with some embodiments of the disclosed subject matter.

DETAILED DESCRIPTION

A modular inline pedal system and methods for using the same are provided.

Generally speaking, the mechanisms described herein relate to a pedalboard apparatus that handles audio signals and musical instrument digital interface (MIDI) command signals from a musical instrument and from instrument pedals, while also providing variable voltages to each instrument pedal. The pedalboard apparatus can include multiple pedal attachment regions, where each pedal attachment region is configured to receive an instrument pedal such that, upon connection, the instrument pedal communicates with the pedalboard apparatus without requiring instrument cables (e.g., quarter-inch cables) between each instrument pedal and an amplifier and without requiring a separate power supply for each instrument pedal.

Note that the pedalboard apparatus is capable of operating in stereo, dual mono, mono input and stereo output, or any other suitable combination thereof.

It should be noted that an instrument pedal that is configured to connect with the pedalboard apparatus can receive an audio signal, such as an audio signal from a musical instrument, an audio signal from another instrument pedal, and/or an audio signal from a computing device, and can modify and/or manipulate the audio signal based on the configured effect associated with the instrument pedal.

Examples of configured effects in an instrument pedal for a guitar can include a boost pedal, an overdrive pedal, a distortion pedal, a fuzz pedal, an Octavia pedal, a reverb pedal, an analog delay pedal, a digital delay pedal, a tremolo pedal, a chorus pedal, a flanger pedal, a univibe pedal, a phase shifter pedal, a compressor pedal, a volume pedal, a wah-wah pedal, etc.

The audio signal from a musical instrument can, in some embodiments, be an analog audio signal. For example, a guitar can output analog audio signals, such as analog string signals or analog audio signals generated by guitar pickups or transducers when guitar strings are strummed. In another example, using these transducers, the analog audio signal can be amplified using an amplifier or any suitable device capable of accepting an audio output to produce a musical sound through a speaker device.

The audio signal from a musical instrument can, in some embodiments, be a digital audio signal. For example, a guitar can generate an analog audio signal, convert the analog audio signal into a digital audio signal, format the digital audio signal in accordance with a digital communication protocol, and/or output the formatted digital audio signal. In another example, a musical instrument can be configured to output digital audio signals.

It should be noted that the pedalboard apparatus can receive any suitable analog audio signal and/or any suitable digital audio signal.

Figure 1:
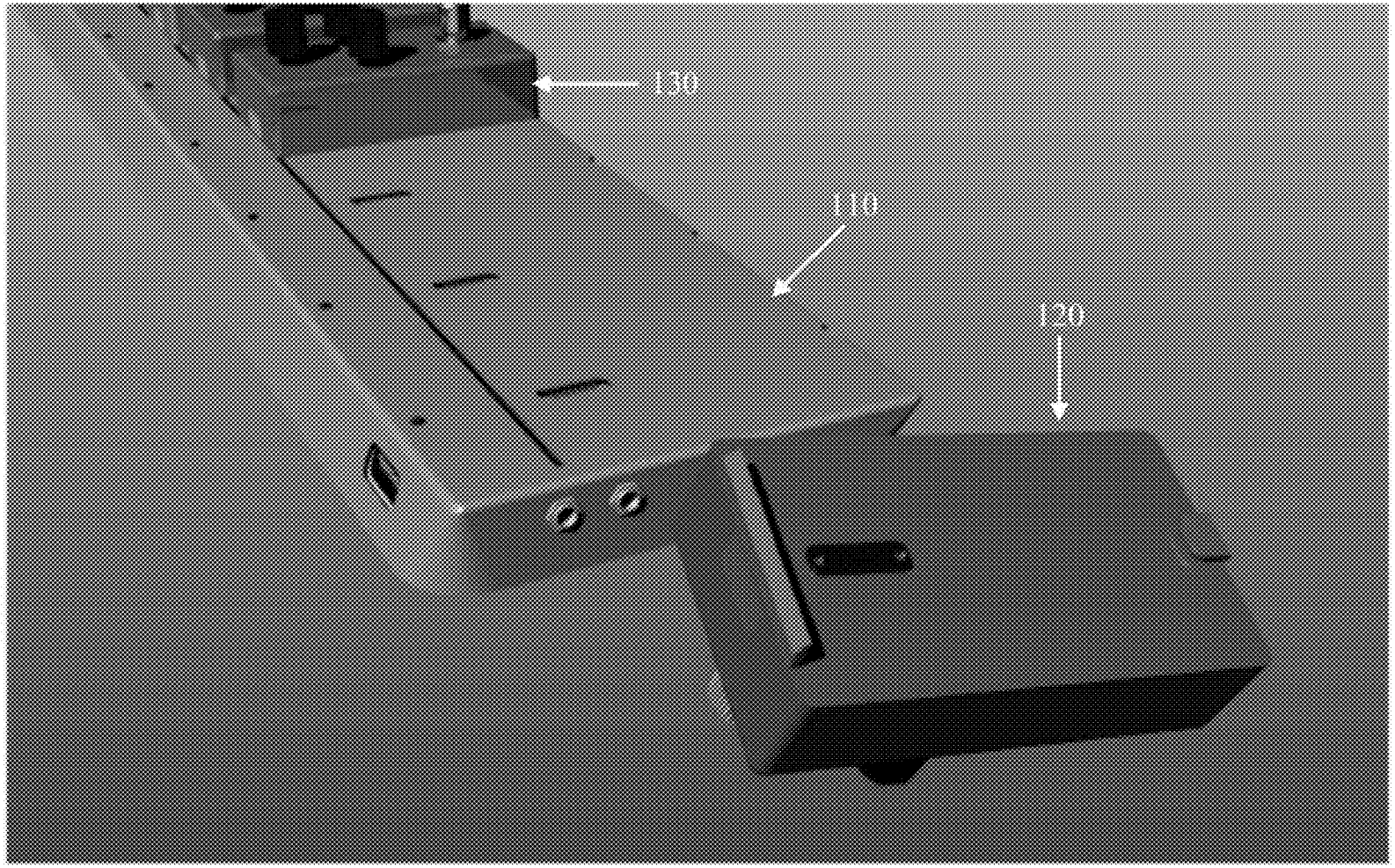
FIG. 1 shows an illustrative example of a pedalboard apparatus that includes connected instrument pedals and an instrument pedal for connecting to a pedal attachment region on the pedalboard apparatus in accordance with some embodiments of the disclosed subject matter.
Figure 2:
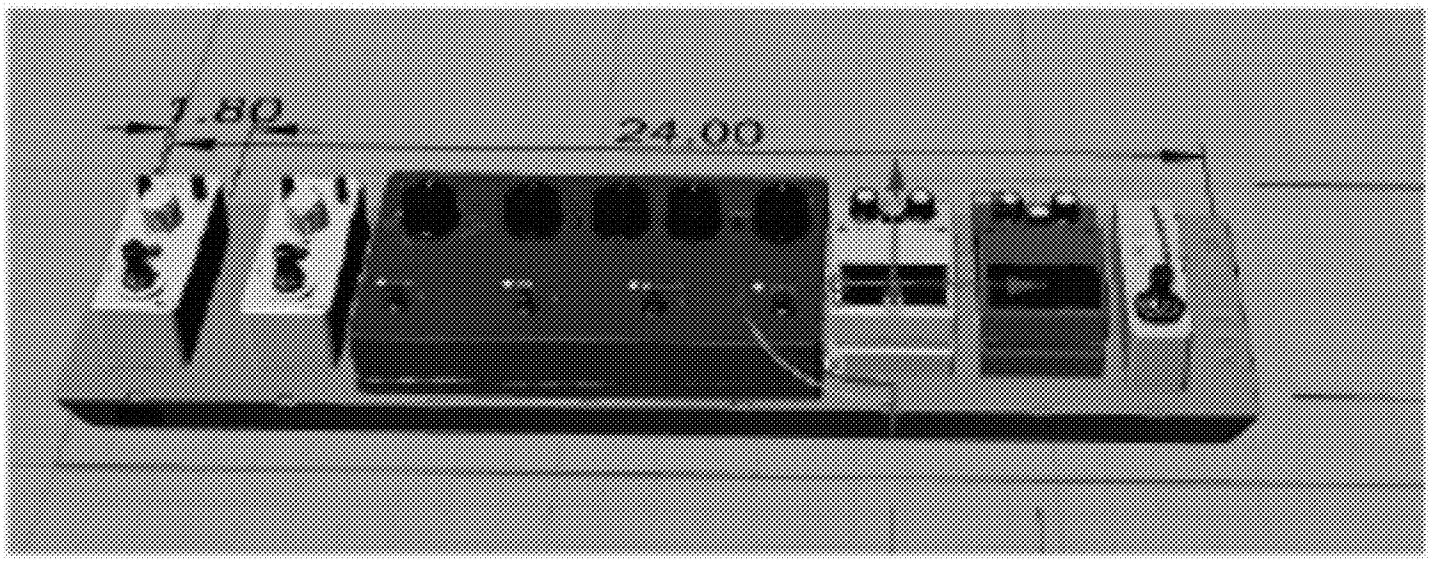
FIG. 2 shows an illustrative example of a pedalboard apparatus that includes multiple connected instrument pedals in accordance with some embodiments of the disclosed subject matter.

For example, as shown in FIG. 1, a pedalboard apparatus 110 is shown in which an unattached instrument pedal 120 can be connected with a pedal attachment region of pedalboard apparatus 110 and attached instrument pedals 130 are currently connected with respective pedal attachment regions of pedalboard apparatus 110. In a more particular example, as shown in FIG. 1, each instrument pedal 120 can include a protrusion (or multiple protrusions) on a rear surface of instrument pedal 120 (e.g., at an upper portion and a lower portion on the rear surface of instrument pedal 120) to mount instrument pedal 120 and a connector on a rear surface of instrument pedal 120 to connect instrument pedal 120 to pedalboard apparatus 110. An illustrative example of varying instrument pedals that have each been connected to a pedal attachment region of the pedalboard apparatus is shown in FIG. 2.

In some embodiments, a pedalboard apparatus, such as the pedalboard apparatus 110 shown in FIG. 1, can be connected to another pedalboard apparatus (e.g., in a daisy chain configuration). This can, for example, provide an instrument with a greater number of connected instrument pedals, while the power and audio signals are routed through the multiple pedalboard apparatuses (e.g., as opposed to individual instrument pedals).

Figure 3:
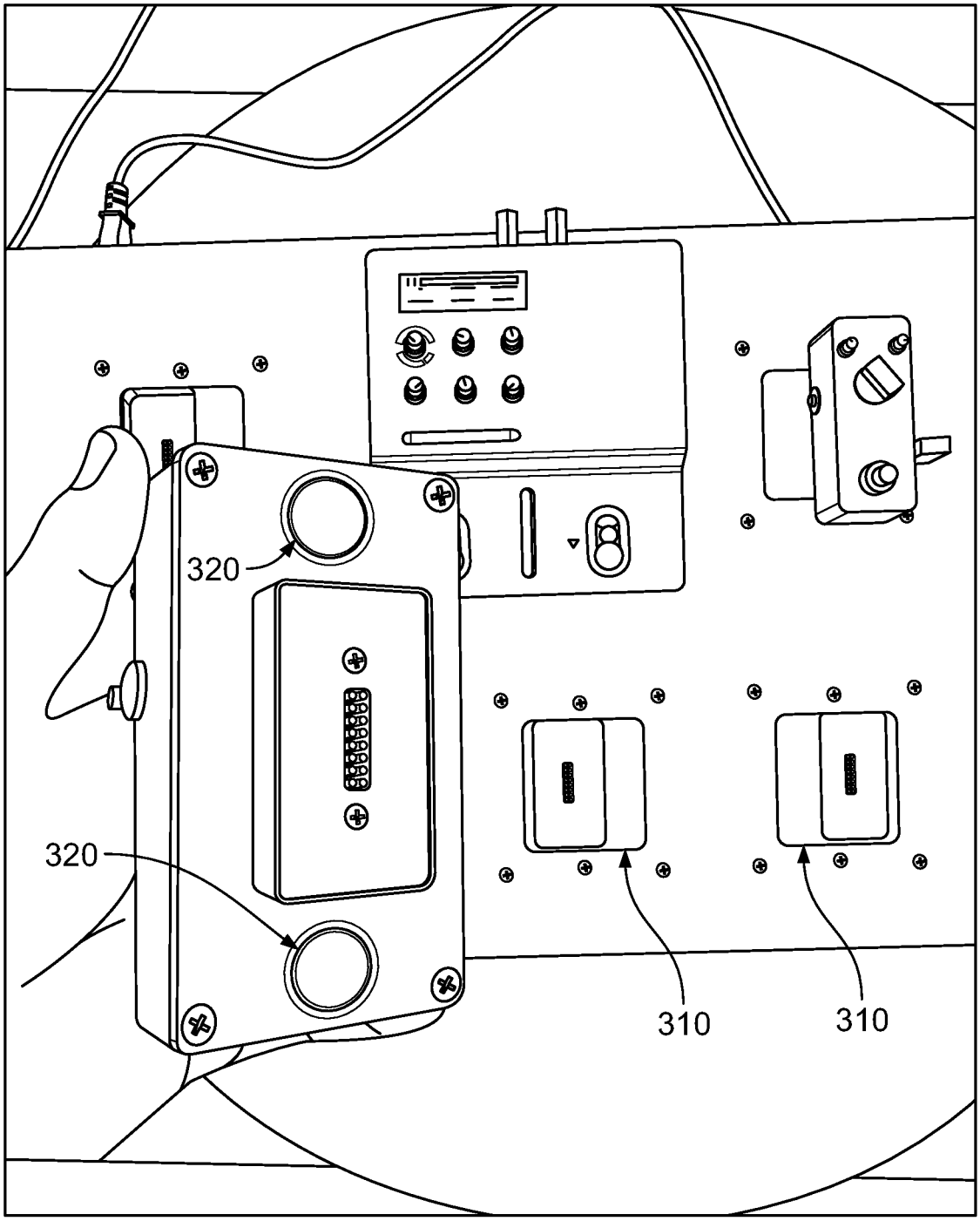
FIG. 3 shows an illustrative example of a pedalboard apparatus that includes connected instrument pedals and an instrument pedal for connecting to a pedal attachment region on the pedalboard apparatus, wherein the instrument pedal includes pins for connecting to a pin connector on the pedalboard apparatus and where the pedal attachment regions on the pedalboard apparatus include sliders for receiving the instrument pedal, in accordance with some embodiments of the disclosed subject matter.
Figure 4:
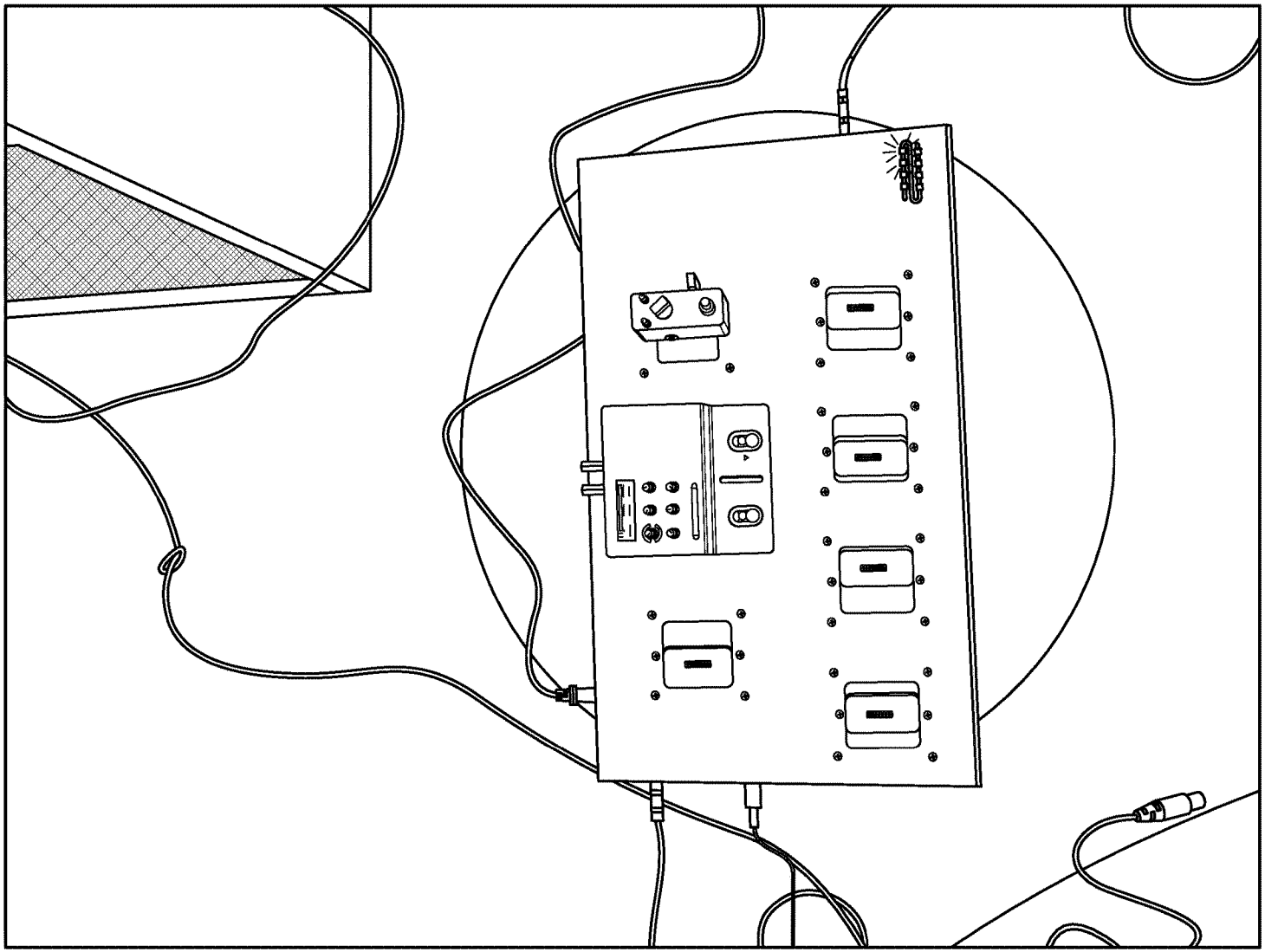
FIG. 4 shows an illustrative example of a pedalboard apparatus that includes connected instrument pedals and audio and power cables associated with the pedalboard apparatus in accordance with some embodiments of the disclosed subject matter.

Additional illustrative examples of the pedalboard apparatus and one or more instrument pedals that can be connected to the pedalboard apparatus are shown in FIGS. 3 and 4.

Figure 5:
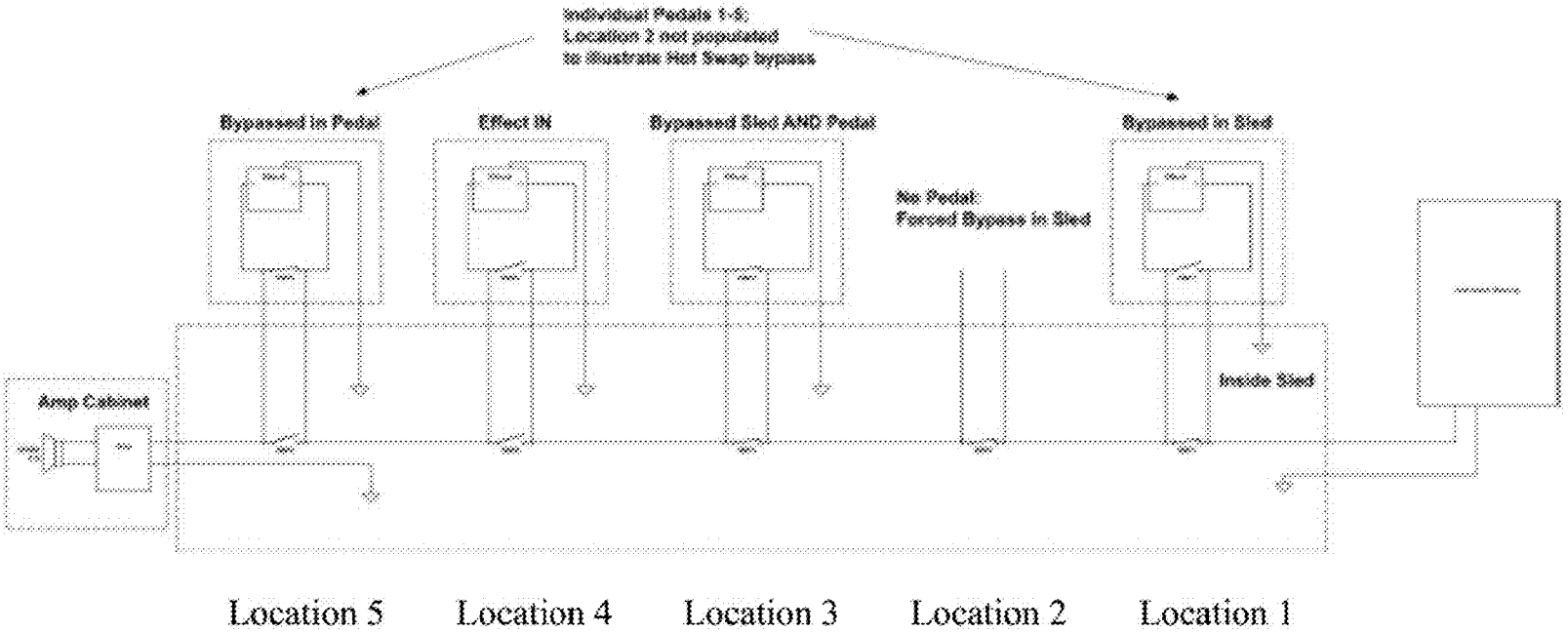
FIG. 5 shows an illustrative schematic diagram of a bypass circuit of the pedalboard apparatus in accordance with some embodiments of the disclosed subject matter.

It should also be noted that the instrument pedal, upon being connected with the pedalboard apparatus at a pedal attachment region, can be selectively switched between an active (or "on") state and a bypass (or "off") state using a foot switch, such as a foot pedal, a button, or any other suitable activation mechanism. In some embodiments, the pedalboard apparatus includes a bypass circuit that causes the audio signal to pass through the instrument pedal when the instrument pedal is in an active state. In instances where the instrument pedal is in a bypass state, the bypass circuit of the pedalboard apparatus causes the audio signal to remain in the pedalboard apparatus and proceed to an active instrument pedal or to an output of the pedal apparatus. As shown, for example, in FIG. 5, a bypass circuit of the pedalboard apparatus is shown. In this example, an instrument pedal at a first pedal attachment region (Location 1) has been bypassed within the pedalboard apparatus, an instrument pedal has not been connected at a second pedal attachment region (Location 2), an instrument pedal at a third pedal attachment region (Location 3) has been bypassed within the pedalboard apparatus and within the instrument pedal, an instrument pedal at a fourth pedal attachment region (Location 4) is being used to modify the audio signal with the associated effect ("Effect IN"), and an instrument pedal at a fifth pedal attachment region (Location 5) has been bypassed within the instrument pedal. It should be noted that, in some embodiments, the audio signal only passes through an instrument pedal when that pedal is in the "on" or active position and, when the pedal is bypassed or in the "off" position, the audio signal remains in the pedalboard apparatus and proceeds to the next instrument pedal for processing or towards the outputs of the pedalboard apparatus. For example, as shown in FIG. 5, the audio signal received from an instrument can flow within the pedalboard apparatus from instrument pedal to instrument pedal (e.g., pedals at Location 1 through Location 5) until the audio signal or modified audio signal is output to an amplifier that is connected to the pedalboard apparatus or any other suitable device that is capable of accepting an audio output. This can, for example, allow the signal to continue, uncorrupted and/or unaltered, in instances where a particular instrument pedal is damaged or the audio signal is degraded upon being passed through the instrument pedal.

It should further be noted that the instrument pedal includes a housing that contains the audio processing circuitry needed to generate a particular audio effect and any suitable controls, such as the switch to activate or deactivate the instrument pedal.

Figure 6:
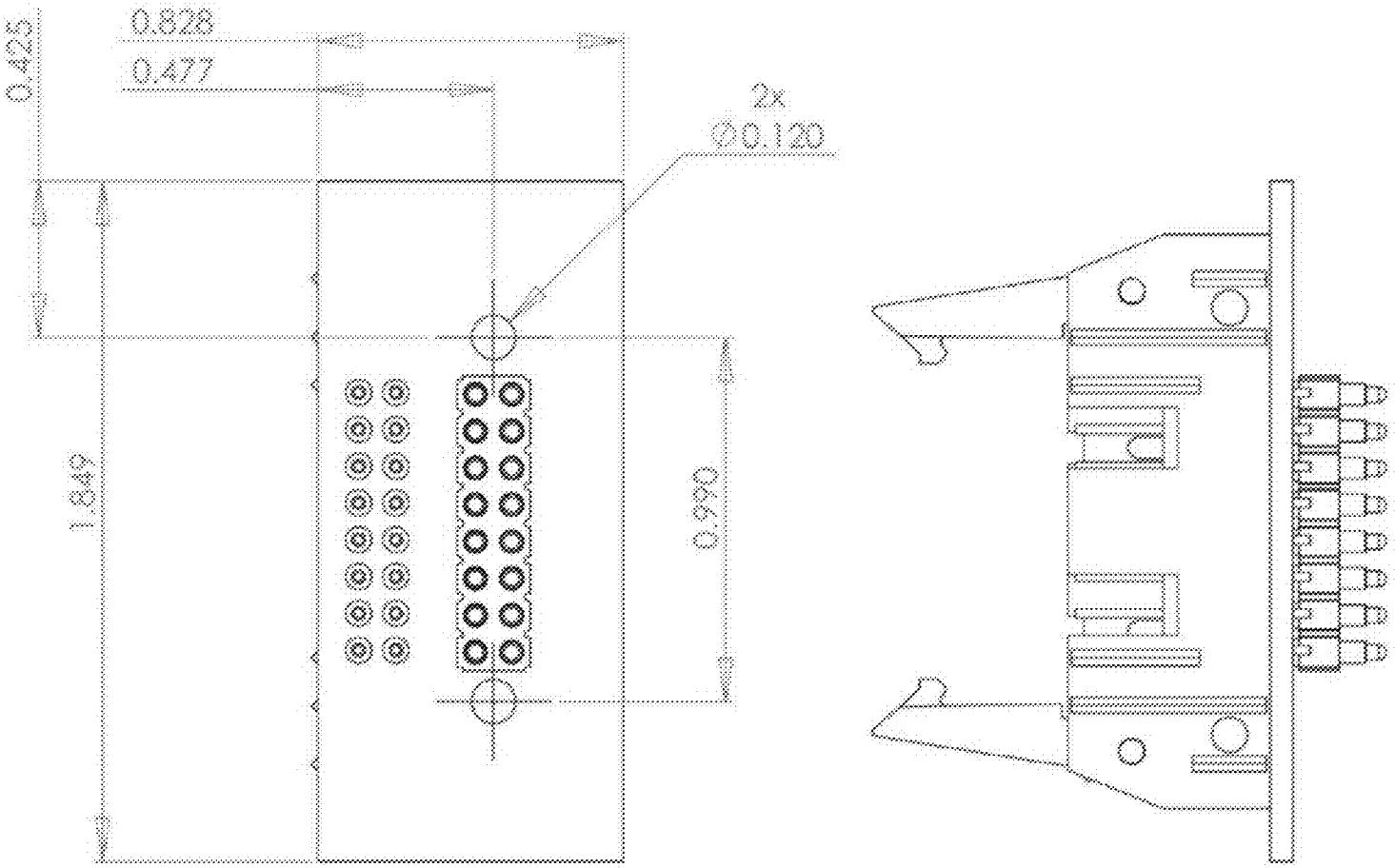
FIG. 6 shows an illustrative schematic diagram of a circuit board within an instrument pedal that includes a set of pins and a hinge for connecting the instrument pedal to the pedalboard apparatus in accordance with some embodiments of the disclosed subject matter.
Figure 7:
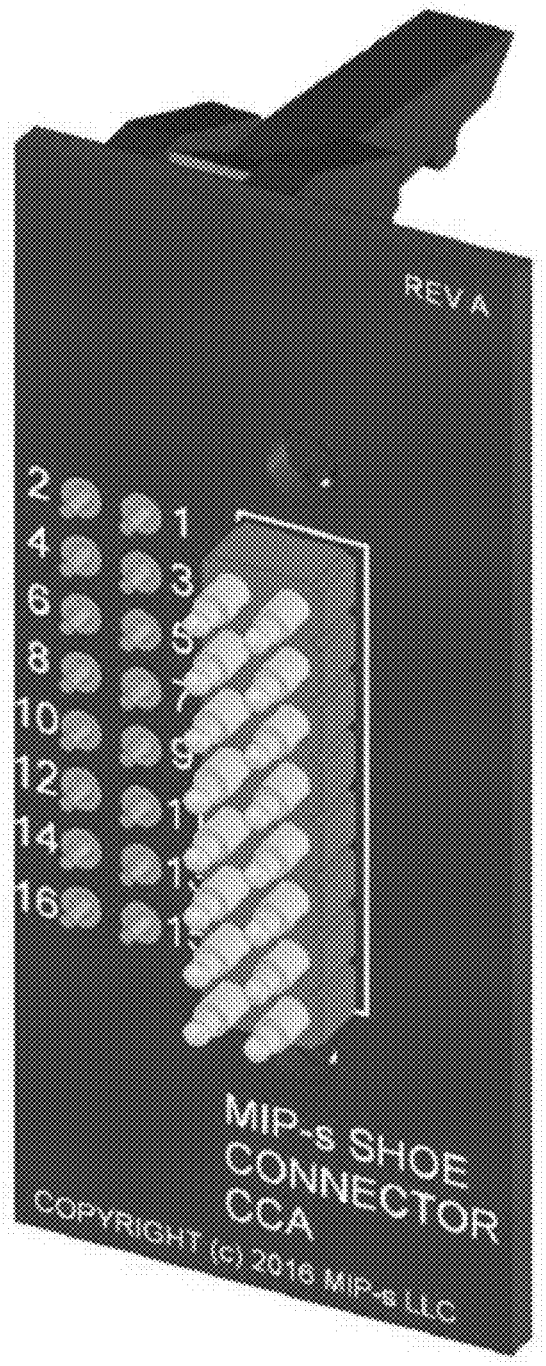
FIG. 7 shows an illustrative perspective view of the circuit board within an instrument pedal that includes a set of pins and a hinge for connecting the instrument pedal to the pedalboard apparatus in accordance with some embodiments of the disclosed subject matter.

In some embodiments, a rear portion of the housing can include a set of pin targets for connecting with a corresponding set of pins in a pedal attachment region of the pedalboard apparatus. For example, an instrument pedal can include a set of pin targets or connectors, such as the two rows of sixteen total pins on a rear portion of the instrumental pedal housing shown in FIG. 3. FIGS. 6 and 7 show examples of sets of pins in a pedal attachment region of the pedalboard apparatus. FIG. 8 shows a connector circuit board within an instrument pedal, which includes a circuit board including a set of sixteen pins on one side of the connector circuit board and a hinged pedal connector for connecting the instrument pedal to the pedal attachment region of the pedalboard apparatus.

Note that, in some embodiments, the pedalboard apparatus can provide different power voltages via a corresponding pin connector, thereby allowing different pedals to access a needed power voltage via specific pins on the pin connector. For example, in some embodiments, a first group of pins (e.g., pins 5 and 6, and/or any other suitable pins) of the pin connector can provide a first power voltage (e.g., 9 Volts, and/or any other suitable voltage), and a second group of pins (e.g., pins 7 and 8, and/or any other suitable pins) of the pin connector can provide a second power voltage that is different from the first power voltage (e.g., 12 Volts, and/or any other suitable voltage), thereby allowing pedals that require different supply voltages to be connected to the same pedalboard apparatus. Note that, in some embodiments, a particular pin (e.g., pin 1, and/or any other suitable pin) can serve as a ground, and all available supply voltages can use the particular ground pin.

In some embodiments, the set of pins can be connected to an expansion connector. For example, an expansion connector can convert to the sixteen total pins so that it can be connected with a differing connector in a pedal attachment region of the pedalboard apparatus. In another example, an expansion connector can modify the pin assignments associated with the current sixteen pins. In yet another example, an expansion connector can allow an instrument pedal having a first type of pins to be connected with a pedal attachment region of the pedalboard apparatus having a pin connector of a second type. In a more particular example, an expansion connector can be used to accommodate one or more rows or columns of pins and pin targets beside or above/below the current sixteen pins.

It should be noted that, although the housing described herein includes a set of pins on a rear portion of the housing, the set of pins or pin connection mechanism can be located at any suitable portion of the housing. For example, a lower face of the housing can include the set of pins. In another example, different sets of pins can be positioned on the housing, where each set of pins can be used with a different pin connector.

In some embodiments, a pin or a particular set of pins can be configured to handle a particular feature. For example, each instrument pedal connected to the pedalboard apparatus can have varying power requirements and, as such, a pin or particular pins can be used to provide individual power needs. In a more particular example, using the set of pins shown in FIGS. 3, 6, and 7, a 9 volt signal can be provided through pins 5 and 6 while a 12 volt signal can be provided through pins 7 and 8.

It should be noted that, although any suitable number of pins can be used and any suitable pin can be assigned to perform any suitable task, the multi-pin connector shown in FIGS. 3, 6, and 7 is merely illustrative. It should also be noted that a particular pin assignment can be designed for a particular pedalboard apparatus such that instrument pedals having pins that comply with the particular pin assignment can be manufactured.

Figure 9:
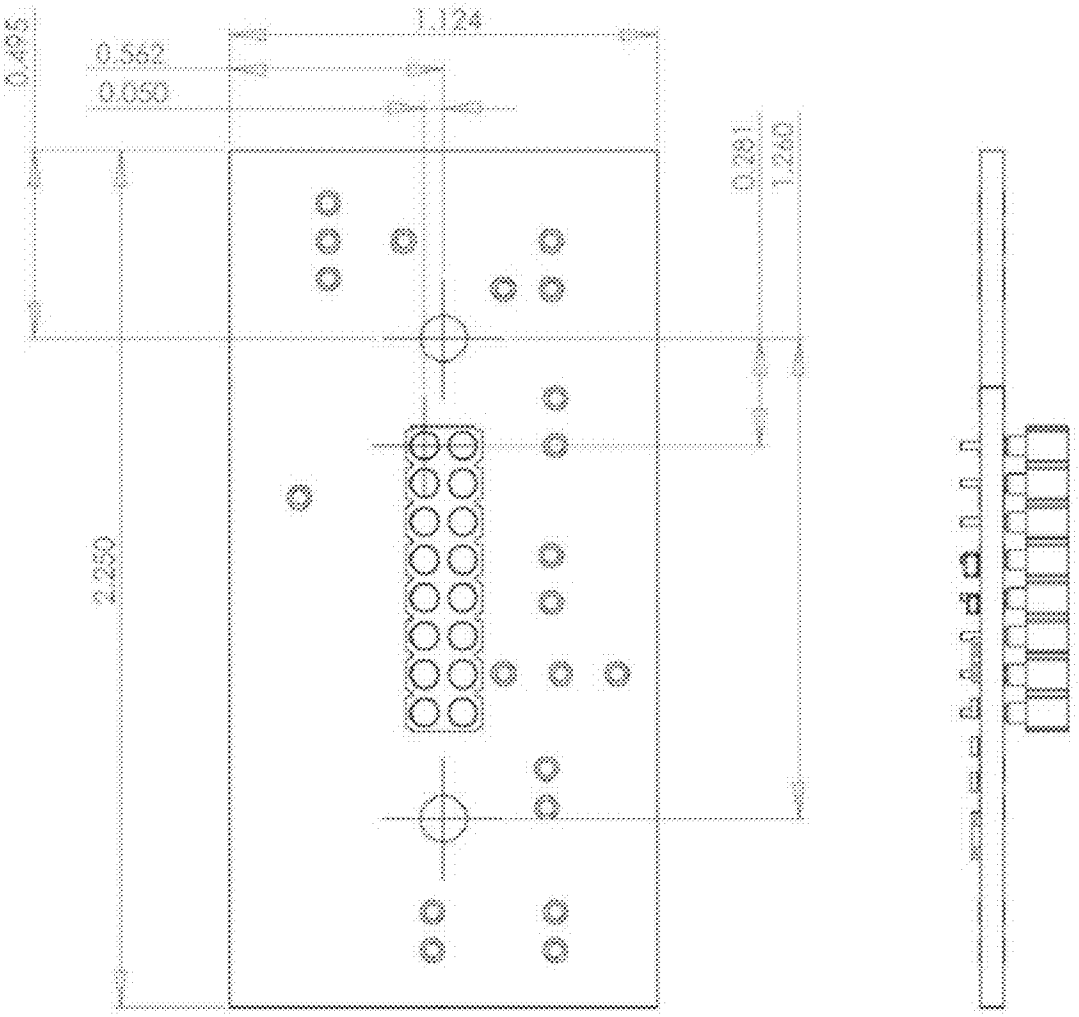
FIG. 9 shows an illustrative schematic diagram of a circuit board positioned within a pedal attachment region of the pedalboard apparatus in accordance with some embodiments of the disclosed subject matter.

In some embodiments, the pins positioned on the rear portion of the housing of the instrument pedal can connect to a multi-pin connector that is positioned within a pedal attachment region of the pedalboard apparatus. For example, as shown in FIGS. 8 and 9, the pedalboard apparatus can include, at each pedal attachment region for receiving an instrument pedal, a circuit board including a multi-pin connector. In a more particular example, a spring-loaded multi-pin connector can be used to achieve the connection between an instrument pedal and the pedalboard apparatus. It should be noted that the use of spring-loaded, high cyclic, multi-pin connectors in the pedalboard apparatus can, for example, provide a reliable connection between instrument pedals and the pedalboard apparatus.

It should be noted that, in some embodiments, different multi-pin connectors can be integrated into the pedalboard apparatus such that different instrument pedals having different pin configurations can be used with the pedalboard apparatus.

In some embodiments, the pedalboard apparatus can include, within each pedal attachment region, an adjustable slider 310. As shown, for example, in FIGS. 3 and 4, one or more pedal attachment regions on the pedalboard apparatus can include an adjustable slider 310 that includes the female portion of the multi-pin connector for receiving the male pins on an instrument pedal. It should be noted that the adjustable slider 310 of a pedal attachment region can be adjusted to accommodate instrument pedals of varying size. For example, an adjustable slider 310 can be adjusted in a vertical direction (y-axis) and/or a horizontal direction (x-axis) such that the adjustable slider 310 within the pedal attachment region can accommodate instrument pedals of varying sizes that can be connected to the pedalboard apparatus.

It should be noted that, although the embodiments described herein include an adjustable slider 310 to accommodate instrument pedals of varying sizes for connection to the pedalboard apparatus, this is merely illustrative and any suitable mechanism for accommodating instrument pedals of varying sizes can be used. For example, an adjustment mechanism can be provided that allows a user of the pedalboard apparatus to adjust the horizontal and/or vertical position of an instrument pedal connected to a pedal attachment region on the pedalboard apparatus.

Figure 10:
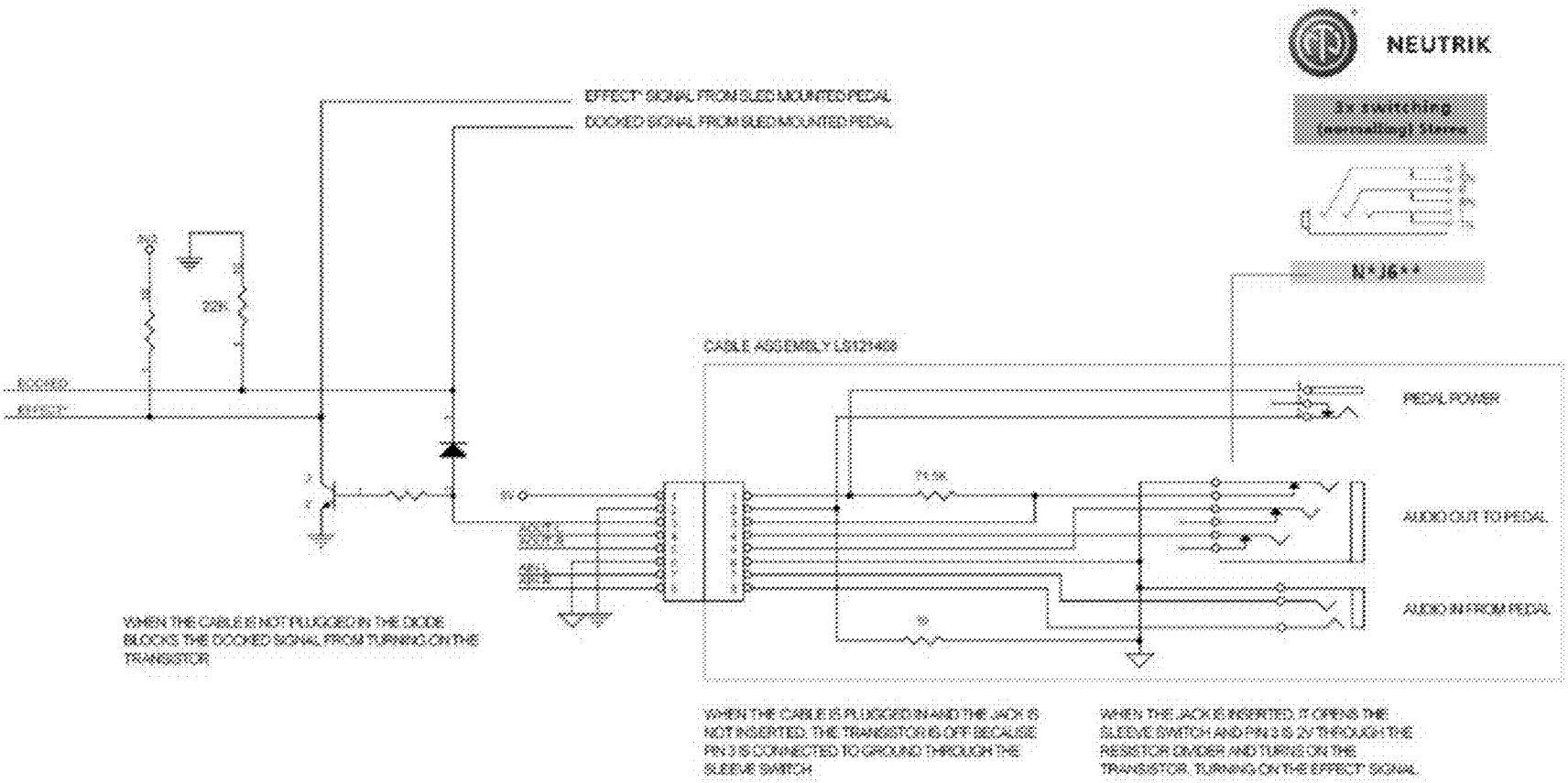
FIG. 10 shows an illustrative external pedal assembly in accordance with some embodiments of the disclosed subject matter.

An illustrative example of a pedal cable assembly in which an instrument pedal is connected to the pedalboard apparatus is shown in FIG. 10.

Figure 11:
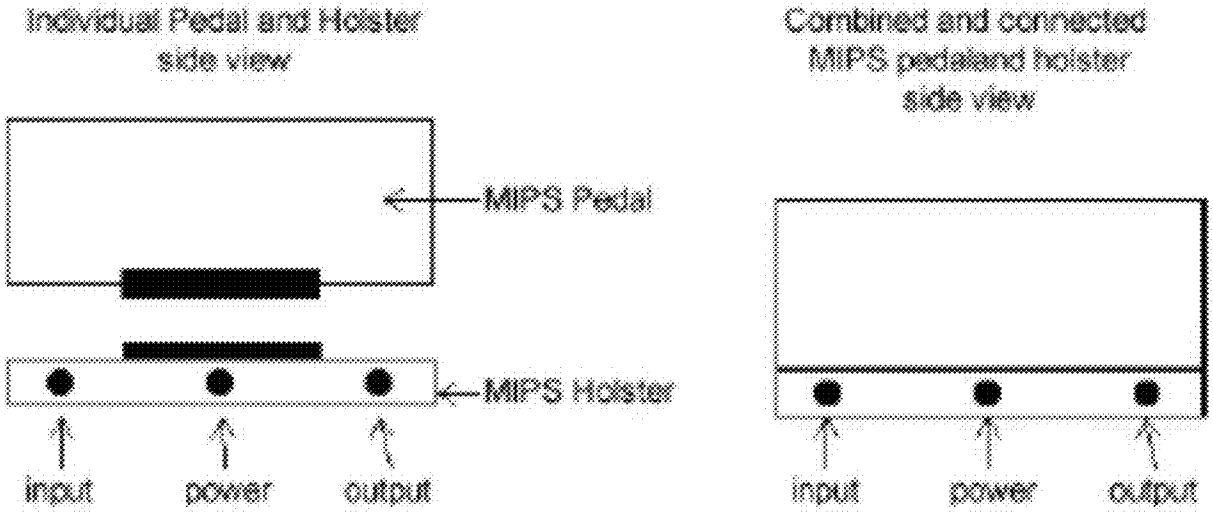
FIG. 11 shows an illustrative example of a holster assembly that receives an upper portion of an instrument pedal and an illustrative example in which the holster assembly and the upper portion of the instrument pedal have been connected in accordance with some embodiments of the disclosed subject matter.

In some embodiments, the pedalboard apparatus can include a holster for receiving an instrument pedal in which the holster is not positioned within a pedal attachment region on the pedalboard apparatus. A more particular example of an illustrative connection between an instrument pedal and a holster on the pedalboard apparatus is shown in FIG. 11. As shown in FIG. 11, an instrument pedal can include an upper portion that contains audio processing components for modifying a received audio signal to create a desired audio effect and controls for controlling an instrument pedal (e.g., active or bypass). As also shown in FIG. 11, the pedalboard apparatus can include a lower portion, which is sometimes referred to as a holster. The lower portion can include the audio connections and the power connections for connecting the instrument pedal with the pedalboard apparatus. As described above, when the upper portion on the instrument pedal is connected to the lower portion on the pedalboard apparatus (e.g., via a pin connector), the unified instrument pedal performs independently from the pedalboard apparatus via the audio and power connections implemented within the lower portion. It should be noted that the holster or lower portion can include a multi-pin connector similar to the multi-pin connector described above for connecting an instrument pedal to the pedalboard apparatus at a pedal attachment region.

Figure 21:
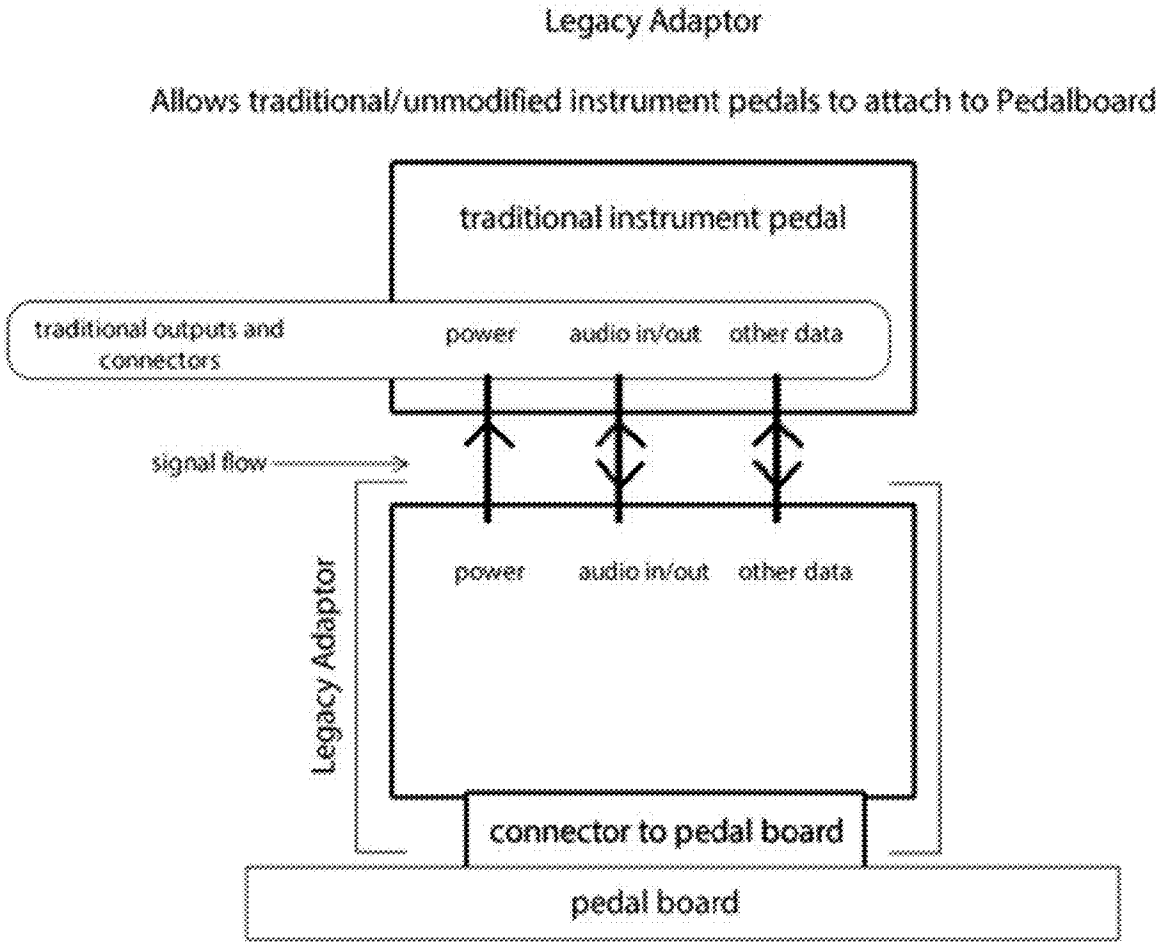
FIG. 21 shows an illustrative schematic diagram for connecting a traditional instrument pedal to a pedalboard apparatus using a legacy adaptor in accordance with some embodiments of the disclosed subject matter.

In some embodiments, an unmodified or traditional instrument pedal (e.g., an older generation instrument pedal designed for traditional pedalboards, an instrument pedal not designed to connect to the pedalboard apparatus described herein, and/or any other suitable type of unmodified or traditional instrument pedal) can be connected to the pedal attachment region of the pedalboard apparatus using a legacy adaptor, as shown in FIG. 21. For example, as shown in FIG. 21, a traditional instrument pedal can be connected to the legacy adaptor, which can in turn be connected to the pedalboard apparatus (e.g., via the holster as described above, and/or in any other suitable manner), thereby allowing any suitable traditional instrument pedal designed to be used with a traditional pedalboard to be used with the pedalboard apparatus described herein. In some embodiments, the legacy adaptor can include any suitable components. For example, in some embodiments, the legacy adaptor can include any suitable pins or pin connectors to connect to the traditional instrument pedal (e.g., pins or connectors for power, audio input or output, and/or any other suitable signals) on a first side of the legacy adaptor, and can include any suitable pins or pin connectors for connecting to the pedalboard apparatus on a second side of the legacy adaptor.

Note that, in some embodiments, a traditional instrument pedal can be connected to the legacy adaptor in any other suitable manner, such as through a Velcro attachment, and/or in any other suitable manner. In some embodiments, cables for interaction with the traditional instrument pedal (e.g., cabling for power of the traditional instrument pedal, cabling for audio input or output, cabling for MIDI, and/or any other suitable cables) can be connected to existing jacks on the traditional instrument pedal, which can then terminate inside the legacy adaptor. In some embodiments, connection of the cabling of the traditional pedal to the legacy adaptor and connection of the legacy adaptor to the pedalboard apparatus can cause power and communication channels to be opened, thereby allowing operation of the traditional instrument pedal with the pedalboard apparatus.

Figure 22:
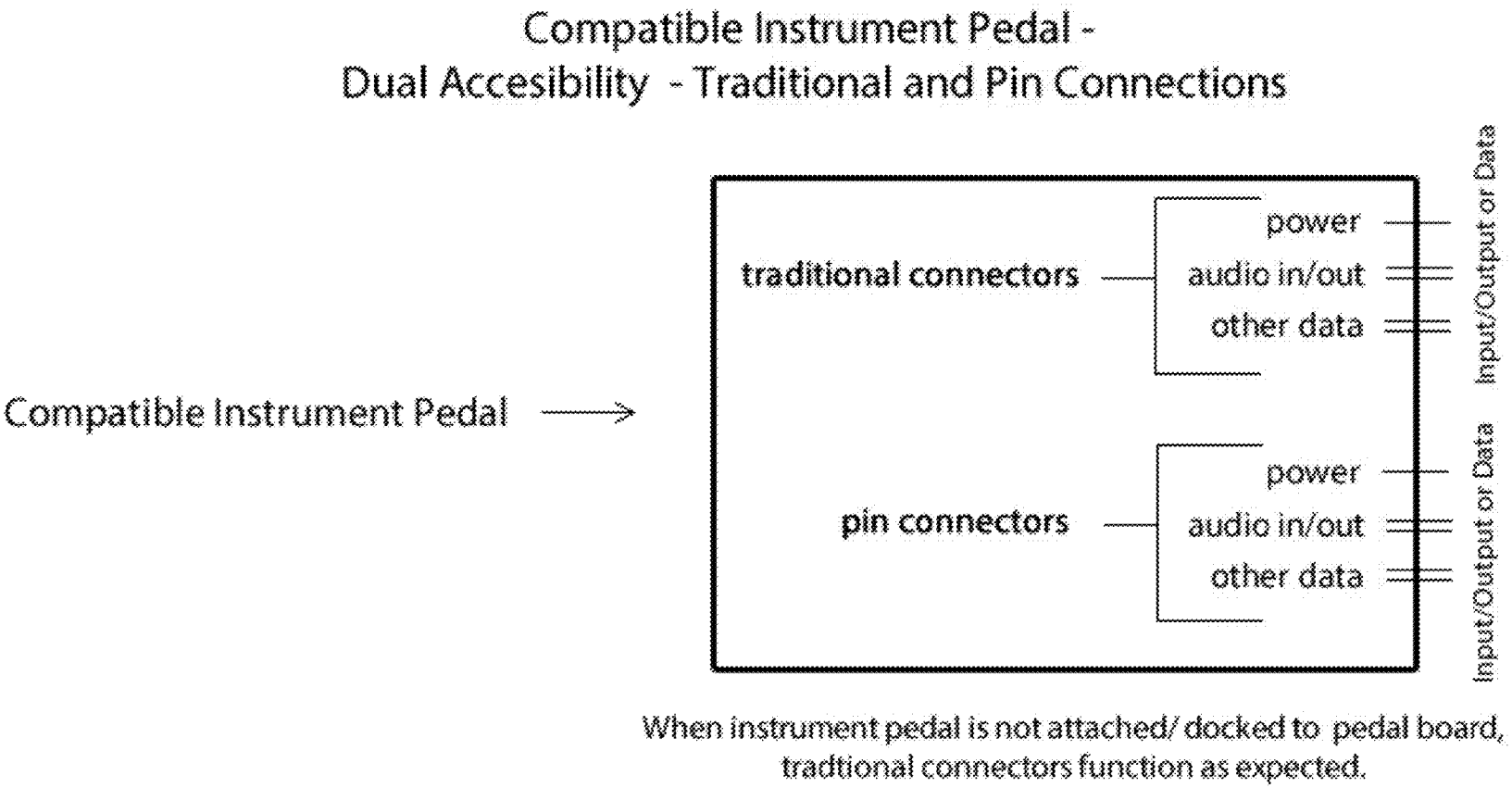
FIG. 22 shows an illustrative schematic diagram of a modified instrument pedal that can be connected to a pedalboard apparatus as described herein or a traditional pedalboard in accordance with some embodiments of the disclosed subject matter.

Note that, in some embodiments, any suitable type of next generation pedal instrument can be connected to the pedalboard apparatus, as shown in FIG. 22. In some embodiments, a next generation pedal can include any suitable pin connectors or other connectors. For example, in some embodiments, a next generation pedal can include a first set of pin connectors that can be used to connect to the pedalboard apparatus, and a second set of traditional connectors that can be used to connect the next generation pedal to a traditional pedalboard if desired.

It should be noted that this can, for example, allow for the instrument pedal to exist on the pedalboard apparatus when attached to a pedal attachment region having a multi-pin connector (and detached from a holster) or on a conventional pedalboard apparatus when attached to a holster.

Figure 18:
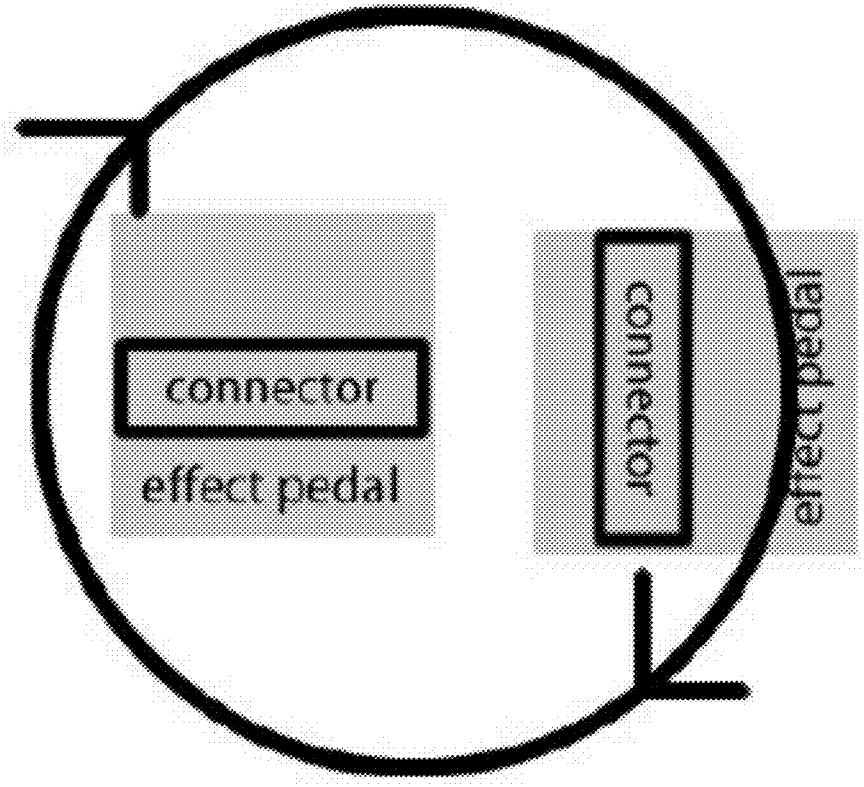
FIG. 18 shows an illustrative example of a rotatable connector for connecting a pedal to a pedal board in accordance with some embodiments of the disclosed subject matter.
Figure 19B:
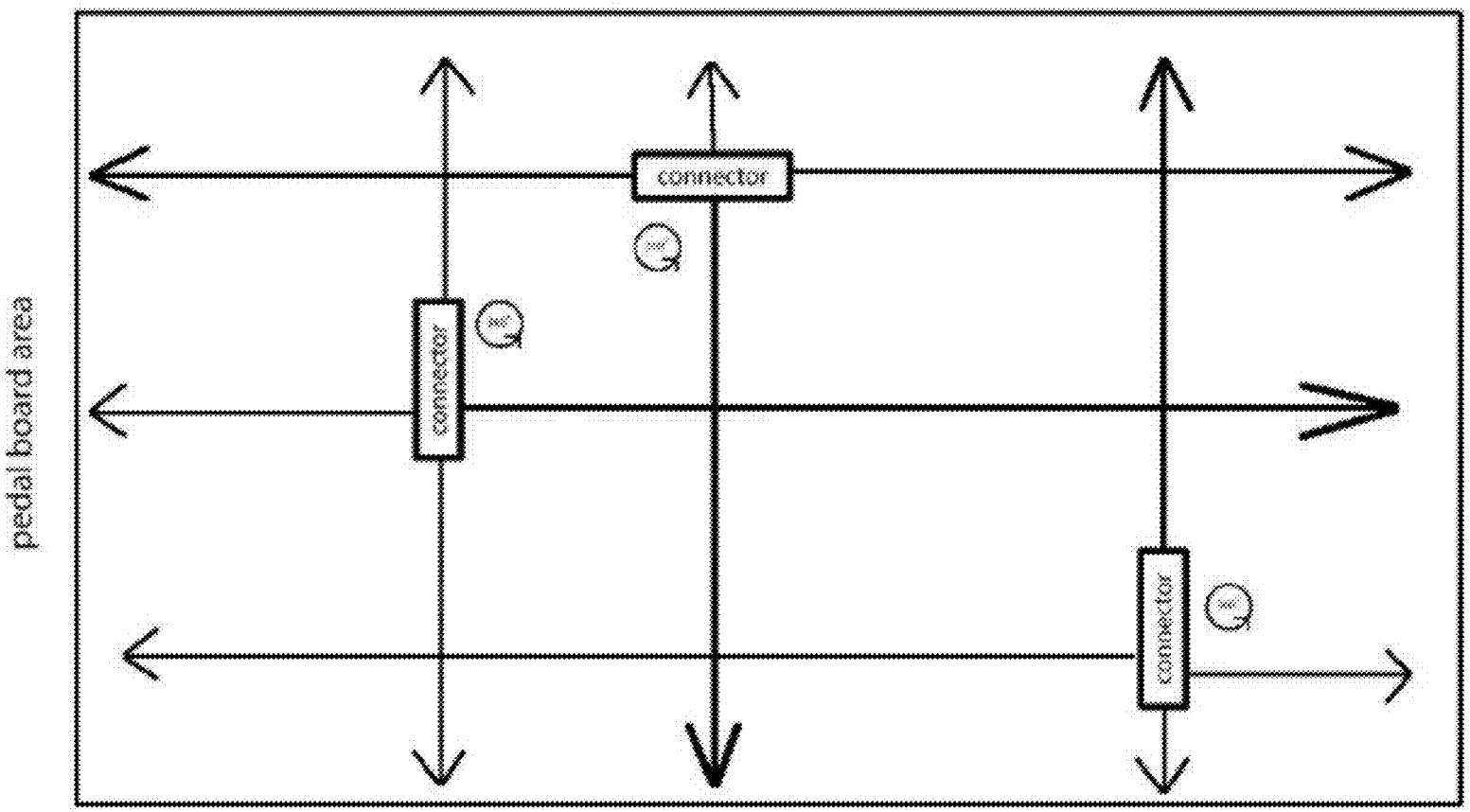

In some embodiments, a connector that connects an instrument pedal to a pedalboard apparatus can rotate in any suitable manner. For example, as shown in FIG. 18, in some embodiments, a connector can rotate 360 degrees, such that an instrument pedal can be placed in any suitable orientation on the pedalboard apparatus. Additionally, in some embodiments, connectors can be placed on a pedalboard apparatus at any suitable location on the pedalboard apparatus and at any suitable orientation or combination of orientations. For example, as shown in FIGS. 19A and 19B, a first group of connectors can be placed in a vertical orientation on the pedalboard apparatus, and a second group of connectors can be placed in a horizontal orientation on the pedalboard apparatus. Additionally, note that, in some embodiments, connectors can be placed at any suitable locations on the pedalboard apparatus (e.g., at any suitable X-Y coordinates on the pedalboard apparatus, and/or at any other suitable locations).

It should also be noted that the holster can include any suitable number of inputs, any suitable number of outputs, and any suitable number of jacks to provide power to the combined and connected instrument pedal.

In some embodiments, the holster can include the bypass circuit described above such that an audio signal can remain in the pedalboard apparatus and bypass the instrument pedal in response to determining that the instrument pedal is in an inactive state or in an "off" state.

In some embodiments, in addition to the pins and the pin connector used to connect an instrument pedal to the pedalboard apparatus, areas of the rear portion of the housing of the instrument pedal or areas of a pedal attachment region on the pedalboard apparatus can include one or more magnets to magnetically connect the instrument pedal to the pedalboard apparatus. For example, as shown in FIG. 3, a set of magnets 320 can be integrated into the rear portion of the housing of the instrument pedal. This set of magnets 320 can, for example, be used to removable attach the instrument pedal to corresponding portions of a pedal attachment region on the pedalboard apparatus. This set of magnets 320 can also, for example, mate the pins with the pin connector and/or align the instrument pedal with the pedalboard apparatus. It should be noted that the set of magnets 320 can, in some instances, cause the housing of the instrument pedal to align with a pedal attachment region on the pedalboard apparatus such that the pins can mate with the pin connector.

In some embodiments, in addition to the pins and the pin connector used to connect an instrument pedal to the pedalboard apparatus, a hinge portion of the housing of the instrument pedal can be used to physically connect the instrument pedal to a receiving portion of the pedalboard apparatus. For example, as shown in FIG. 1, a hinge portion on the top and bottom of a rear surface of the instrument pedal housing can physically connect to corresponding portions on the pedalboard apparatus.

In some embodiments, in response to attaching an instrument pedal to the pedalboard apparatus (e.g., via the pins and pin connector and via the magnetic regions), the pedalboard apparatus can indicate the status of the instrument pedal using one or more light emitting diodes (LEDs). For example, an LED indicator can provide an indication as to whether an instrument pedal has been activated or is in bypass by emitting a particular color light (e.g., a green light for an active state and a red light for a bypass state). In another example, an LED indicator can provide the rate of tap tempo (e.g. by causing an LED to blink at a particular rate or blink to a particular rhythm). In yet another example, an LED indicator can provide an indication as to whether an instrument pedal has been successfully connected to the pedalboard apparatus. In a more particular example, using an internal sensing circuit in the pedalboard apparatus, the LED can indicate (e.g., by blinking at short intervals) if an instrument pedal that is connected to the pedalboard apparatus is not functioning properly (e.g., where a replacement instrument pedal is needed to obtain the desired effect, where an instrument pedal is to be re-inserted into the pedalboard apparatus, etc.).

Figure 12:
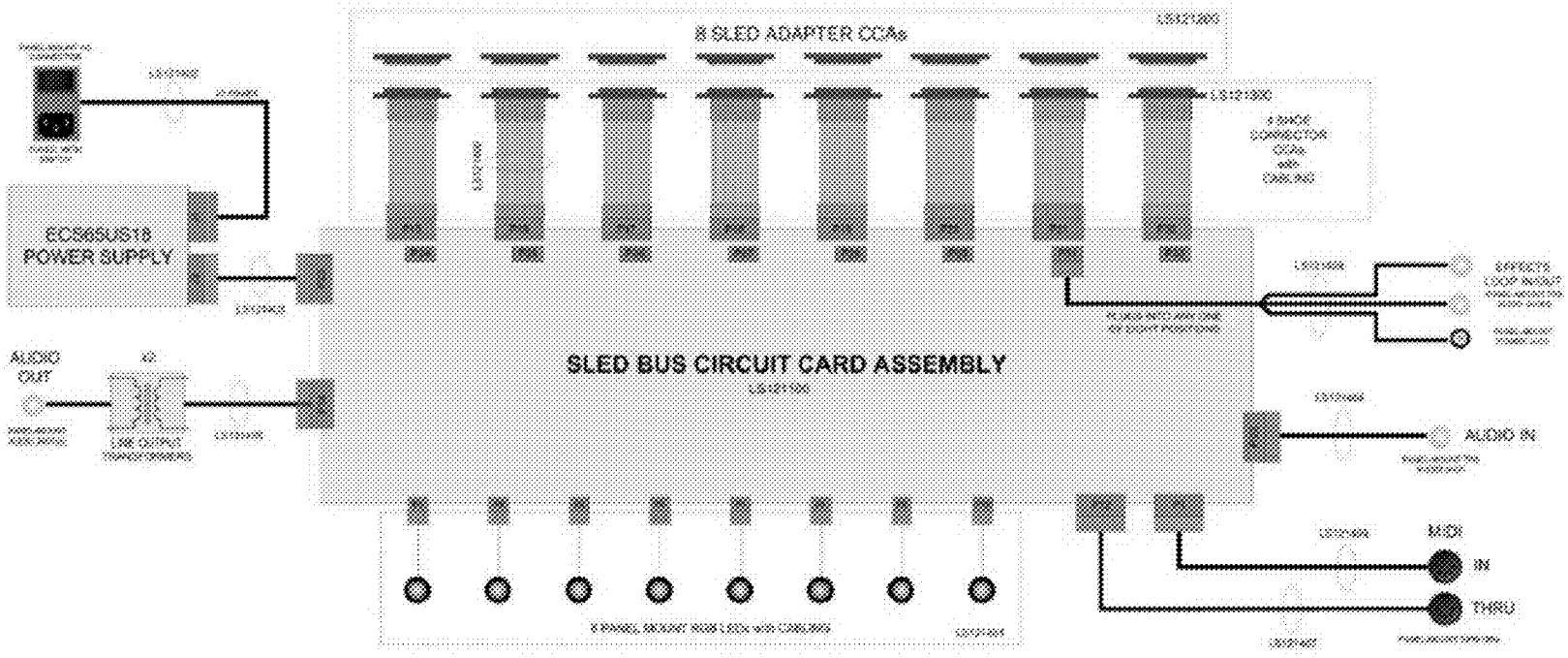
FIG. 12 shows an illustrative schematic diagram of a circuit board positioned within the pedalboard apparatus in which the circuit board shows the multiple interfaces and multiple light emitting diodes connected to the pedalboard apparatus in accordance with some embodiments of the disclosed subject matter.

An illustrative example of the LEDs provided and configured on the pedalboard apparatus is shown in FIG. 12. For example, as shown in FIG. 12, eight LEDs are configured with a circuit card assembly within the pedalboard apparatus, where each LED is associated with a pedal attachment region of the pedalboard apparatus. In response to attaching an instrument pedal to the pedalboard apparatus at a corresponding pedal attachment region, the associated LED can present various indications—e.g., a green light to indicate that the instrument pedal is in an active state, a red light to indicated that the instrument pedal is in a bypass state, a blinking red light to indicate that the instrument pedal is not configured properly, etc.

Figure 13:
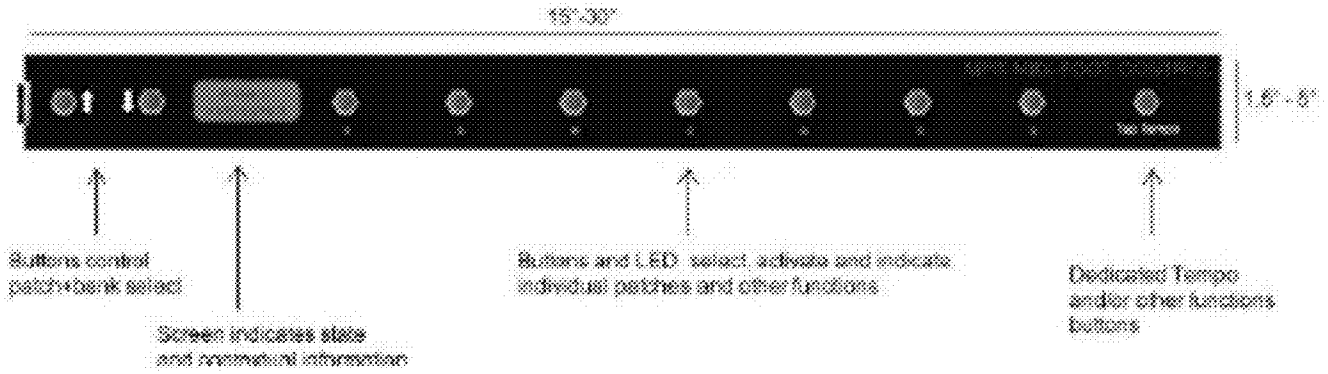
FIG. 13 shows an illustrative example of a MIDI foot controller that can be connected to the pedalboard apparatus in accordance with some embodiments of the disclosed subject matter.

In some embodiments, the pedalboard apparatus can be connected with a MIDI foot controller, such as the MIDI foot controller shown in FIG. 13. For example, the MIDI foot controller of FIG. 13 can be attached to and communicate with the pedalboard apparatus and the instrument pedals that are connected to the pedalboard apparatus. In a more particular example, the MIDI foot controller of FIG. 13 can be attached to a lower portion or foot portion of the pedalboard apparatus, where the MIDI foot controller allows an instrumentalist to control the instrument pedals and pedal functions. In addition, the MIDI foot controller can transmit MIDI commands via MIDI or other electronic signals to the individual instrument pedals attached to the pedalboard apparatus using the internal electrical and audio routing of the pedalboard apparatus that also accepts MIDI commands.

It should be noted that any suitable approach for connecting the MIDI foot control with the pedalboard apparatus can be used. For example, a cable can be used to connect the MIDI foot controller with the pedalboard apparatus.

In some embodiments, the MIDI foot controller can be used to create scenes of multiple pedals in which one or more instrument pedals are moved between an active state and a bypass state. This can, for example, allow the MIDI foot controller to turned on or off multiple instrument pedals with a single pedal input on the MIDI foot controller.

In some embodiments, the MIDI foot controller can be used to transmit tap tempo signals to the multiple instrument pedals that are connected to the pedalboard apparatus using the appropriate pin connection in the multi-pin connector. This can, for example, allow the MIDI foot controller to transmit a time or rate for a time-based effect, such as a delay, a tremolo, or other effect, to all of the instrument pedals connected to the pedalboard apparatus by providing a single pedal input.

In some embodiments, the MIDI foot controller can be used to transmit express pedal input signals to the multiple instrument pedals that are connected to the pedalboard apparatus using the appropriate pin connection in the multi-pin connector.

In some embodiments, the MIDI foot controller can be used to store multiple presets associated with the instrument pedals connected to the pedalboard apparatus. For example, the MIDI foot controller can transmit user-selected presets to a particular instrument pedal upon connection to the pedalboard apparatus. In another example, the MIDI foot controller can transmit user-selected presets when a particular combination of instrument pedals have been connected to the pedalboard apparatus. In yet another example, the MIDI foot controller can assign a particular function to a pedal input on the MIDI foot controller in response to determining the instrument pedals that have been connected to the pedalboard apparatus.

It should be noted that, in some embodiments, the MIDI foot controller can provide additional features to the pedalboard apparatus. For example, the MIDI foot controller can include a transmitter/receiver to provide Bluetooth or wireless connectivity. In another example, the MIDI foot controller can include inputs for connecting one or more additional footswitches, one or more additional pedalboard apparatuses, and/or one or more additional instrument pedals (e.g., instrument pedals that cannot be connected to the pedalboard apparatus).

It should also be noted that, although the embodiments described herein include the MIDI foot controller, any suitable controller can be connected to the pedalboard apparatus. For example, a controller can be connected to the pedalboard apparatus that receives gesture controls from an instrumentalist. In another example, a controller can be connected to the pedalboard apparatus that receives controls in connection with events in music or a performance program.

Figure 14:
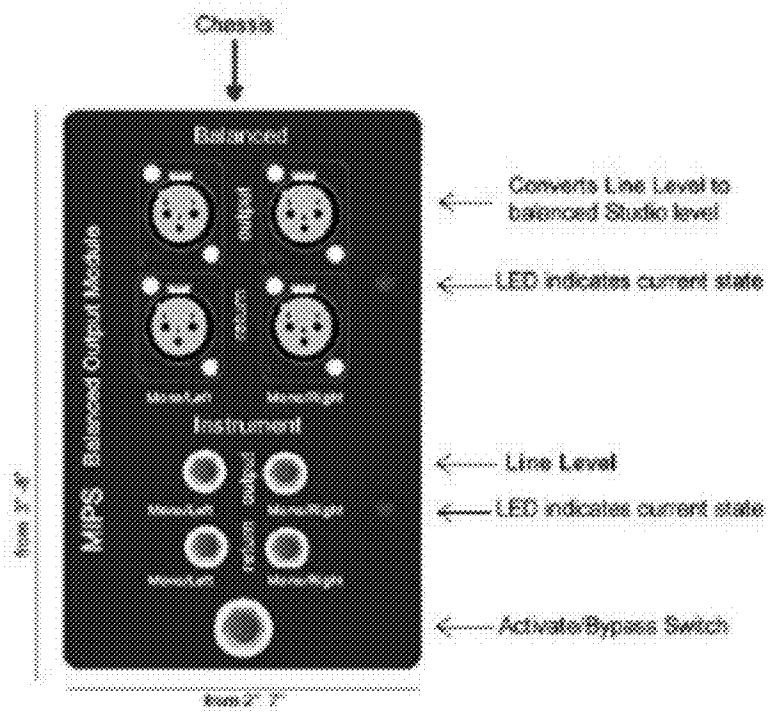
FIG. 14 shows an illustrative example of a balanced input/output pedal module that can be connected to the pedalboard apparatus in accordance with some embodiments of the disclosed subject matter.

In some embodiments, a balanced input/output pedal module can be attached to the pedalboard apparatus. This pedal module can, for example, create inputs and outputs from line level to a balanced level. For example, as shown in FIG. 14, the pedal module can create inputs and outputs from line to a balanced +4 balanced signal and/or a line level signal. In a more particular example, the pedal module can contain any suitable combination of balanced and line audio inputs and audio outputs in mono or in a summed stereo combination. Similar to the holster described above, the balanced input/output pedal module can include an upper portion of the pedal that includes the audio circuitry needed to create a balanced signal as well as suitable inputs and outputs. As also shown in FIG. 14, multiple light emitting diodes can be included on the balanced input/output pedal module to provide an indication of the current state of the pedal module. In response to positioning the balanced input/output pedal module within the pedalboard apparatus, the balanced input/output pedal module can provide a wide variety of audio uses in, for example, a studio environment or a performance environment.

Figure 20:
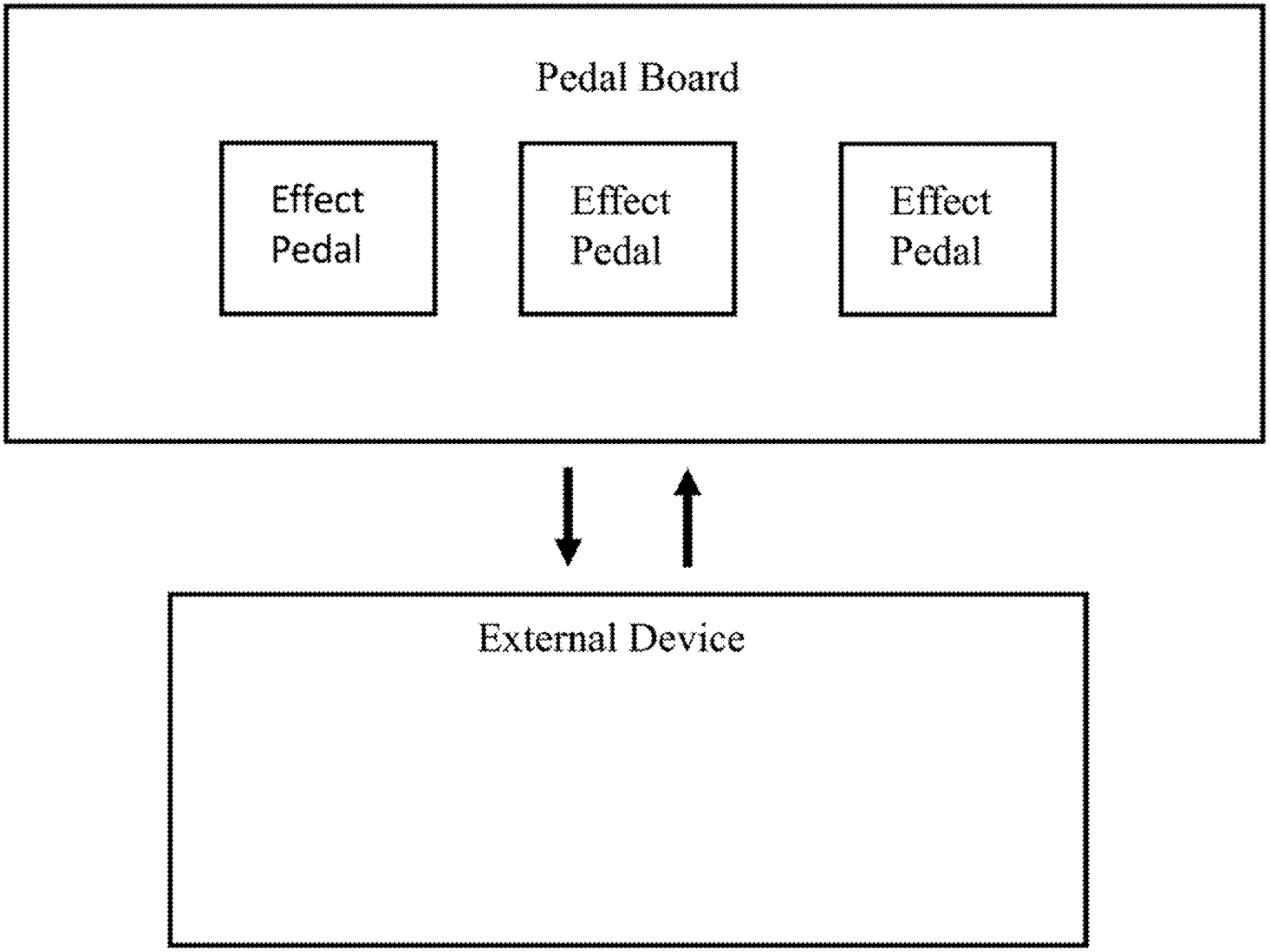
FIG. 20 shows an illustrative schematic diagram for bidirectional communication between a pedal board and an external device in accordance with some embodiments of the disclosed subject matter.

Turning to FIG. 20, an example of a schematic diagram for bidirectional communication between a pedalboard apparatus and an external device is shown in accordance with some embodiments of the disclosed subject matter. As illustrated, in some embodiments, the pedalboard apparatus can determine and/or collect any suitable information about pedals docket to the pedalboard apparatus and can transmit the collected information to any suitable external device. For example, in some embodiments, the pedalboard can determine information about connected pedals, such as a brand of a connected pedal, a MIDI identifier, positioning of the pedal on the pedalboard apparatus, settings associated with the pedal (e.g., factory settings, user preset settings, and/or any other suitable settings), and/or any other suitable information. In some embodiments, the information can be transmitted in any suitable manner from the pedalboard apparatus to the external device (e.g., using any suitable wireless communication link, and/or in any other suitable manner).

Additionally, as shown in FIG. 20, in some embodiments, any suitable information or electronic signals can be transmitted from an external device to the pedalboard apparatus, and from the pedalboard apparatus to any pedals connected to the pedalboard apparatus. For example, in some embodiments, a user input (e.g., to change a setting or behavior associated with a connected pedal), can be transmitted from the external device to the pedalboard apparatus. As another example, in some embodiments, a signal indicating a preprogrammed event can be transmitted from the external device to the pedalboard apparatus. In some embodiments, a transmitted message or signal can be transmitted by the pedalboard apparatus to any suitable pedal or combination of pedals connected to the pedalboard apparatus. For example, in some embodiments, an input indicating a change in behavior of a pedal can be transmitted to a subset of connected pedals (e.g., one connected pedal, two connected pedals, and/or any other suitable number). As another example, in some embodiments, an input can be transmitted to all connected pedals.

Figure 15:
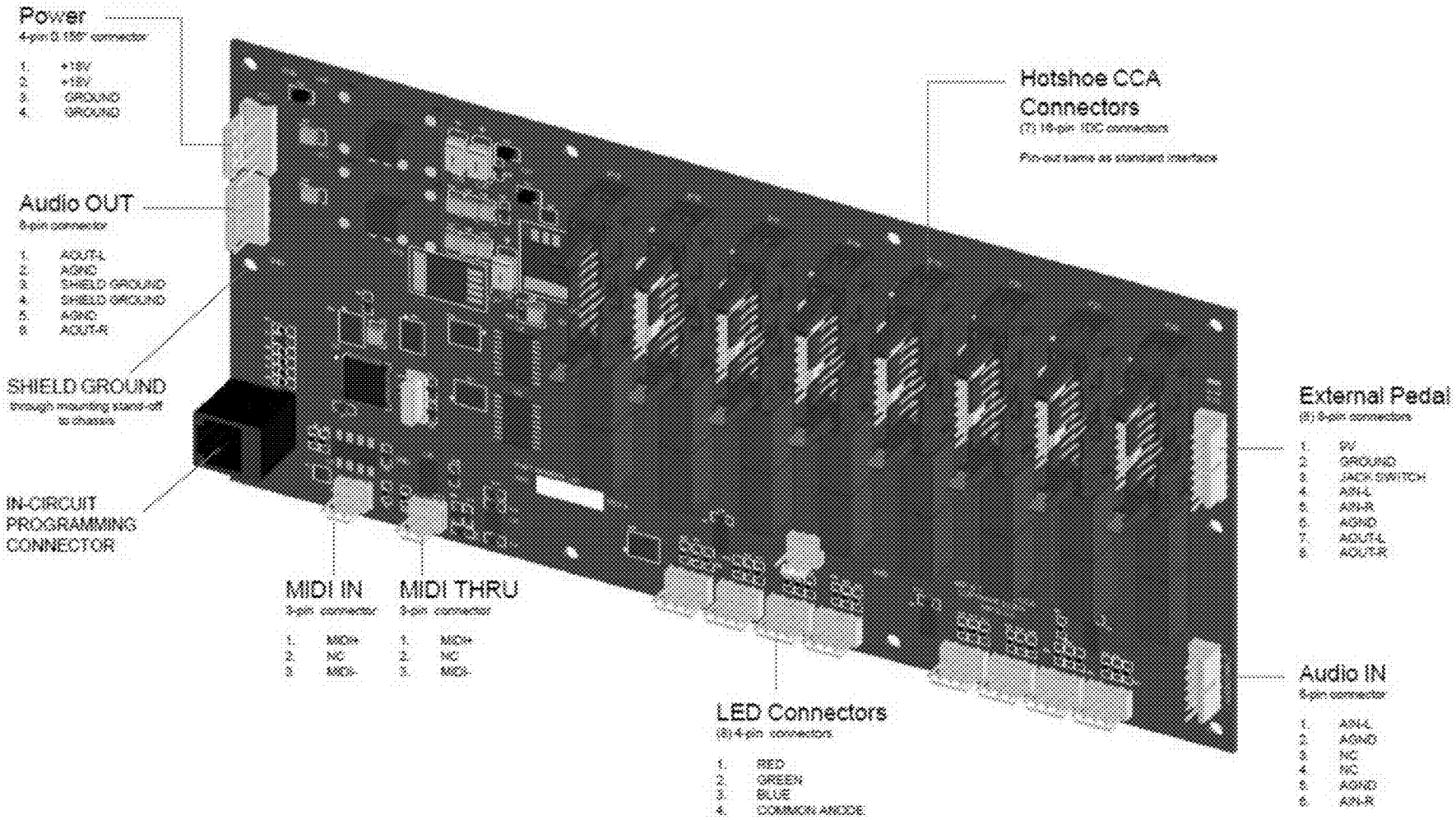
FIG. 15 shows an illustrative perspective view of a circuit board within the pedalboard apparatus in accordance with some embodiments of the disclosed subject matter.
Figure 16:
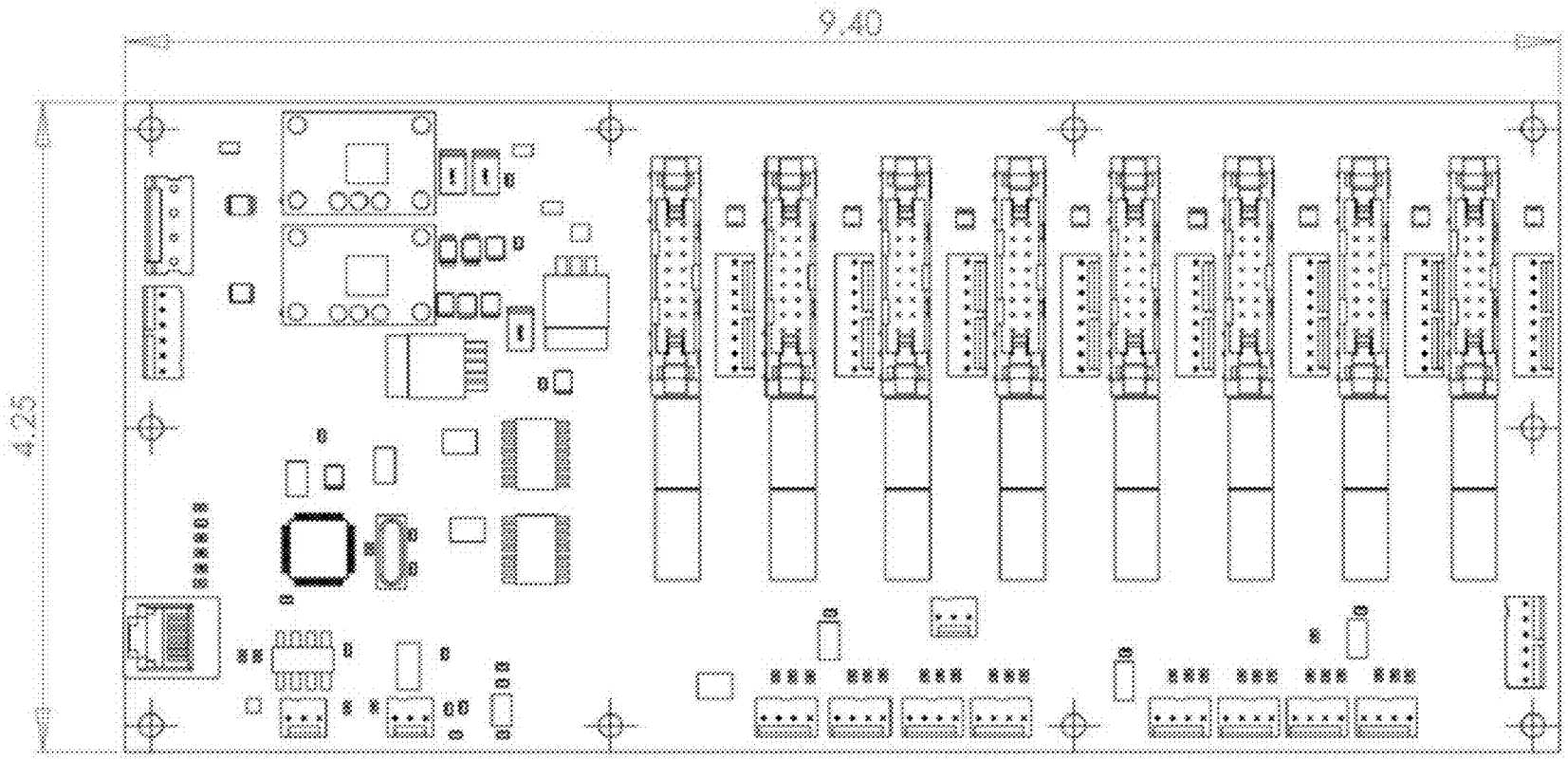
FIG. 16 shows an illustrative schematic diagram of a circuit board within the pedalboard apparatus in accordance with some embodiments of the disclosed subject matter.

An illustrative example of additional connectors to the pedalboard apparatus is shown in FIGS. 15 and 16, where FIG. 15 shows a perspective view of a circuit board within the pedalboard apparatus and FIG. 16 shows a schematic diagram of the circuit board.

In some embodiments, the pedalboard apparatus can include cabling for audio input, audio output, and power to instrument pedals that are not configured for use with the pedal attachment regions and the multi-pin connectors on the pedalboard apparatus.

Figure 17:
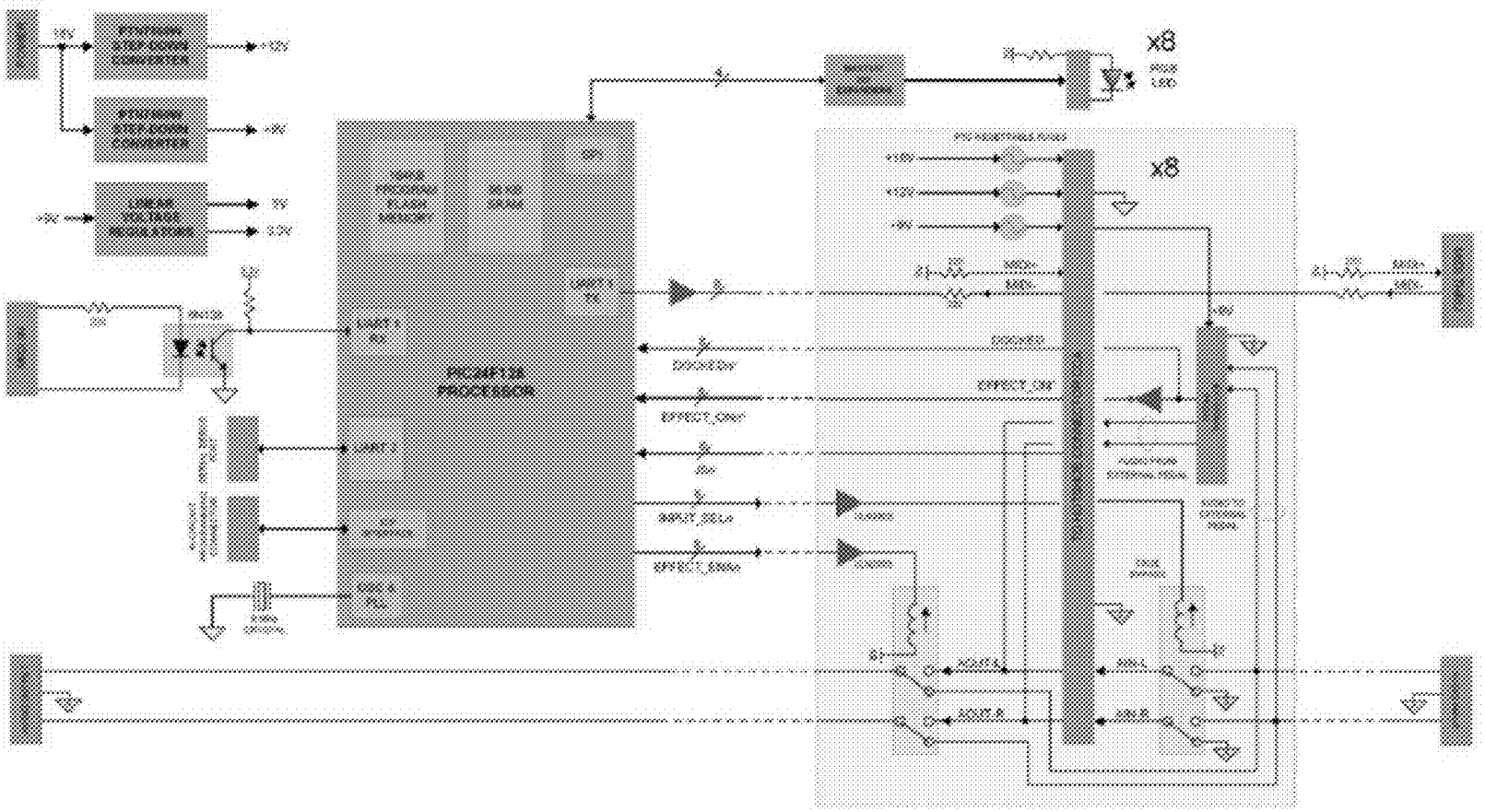
FIG. 17 shows an illustrative circuit diagram in which a hardware processor is connected within the pedalboard apparatus in accordance with some embodiments of the disclosed subject matter.

In some embodiments, the pedalboard apparatus can include a suitable hardware processor for controlling the pedalboard apparatus. For example, as shown in FIG. 17 any suitable hardware and/or software can be used to perform the mechanisms described herein. For example, a general purpose device such as a computer or a special purpose device such as a client, a server, etc. can be used to execute software for performing the mechanisms described herein. Any of these general or special purpose devices can include any suitable components such as a hardware processor (which can be a microprocessor, digital signal processor, a controller, etc.), memory, communication interfaces, display controllers, input devices, etc. This hardware and/or software can be implemented as part of other equipment or can be implemented as stand-alone equipment (which can be coupled to other equipment).

In some embodiments, any suitable computer readable media can be used for storing instructions for performing the functions and/or processes herein. For example, in some embodiments, computer readable media can be transitory or non-transitory. For example, non-transitory computer readable media can include media such as non-transitory forms of magnetic media (such as hard disks, floppy disks, and/or any other suitable magnetic media), non-transitory forms of optical media (such as compact discs, digital video discs, Blu-ray discs, and/or any other suitable optical media), non-transitory forms of semiconductor media (such as flash memory, electrically programmable read-only memory (EPROM), electrically erasable programmable read-only memory (EEPROM), and/or any other suitable semiconductor media), any suitable media that is not fleeting or devoid of any semblance of permanence during transmission, and/or any suitable tangible media. As another example, transitory computer readable media can include signals on networks, in wires, conductors, optical fibers, circuits, any suitable media that is fleeting and devoid of any semblance of permanence during transmission, and/or any suitable intangible media.

In some embodiments, the pedalboard apparatus and its connected instrument pedals can communicate with a computing device (e.g., using a Bluetooth connection, using a wireless connection, using a USB cable, etc.). In response to detecting a connection with the pedalboard apparatus and its connected instrument pedals, the computing device can launch an application that prompts the user to configure the connected instrument pedals and/or configure the pedalboard apparatus. For example, the application can detect the instrument pedals that are currently connected to the pedalboard apparatus and, in response, generate a user interface that prompts the user to provide settings for individual instrument pedals, create scenes of multiple pedals, assign a specific tempo to a particular scene of multiple pedals, etc.

Accordingly, a modular inline pedal system and methods for using the same are provided.

Although the invention has been described and illustrated in the foregoing illustrative embodiments, it is understood that the present disclosure has been made only by way of example, and that numerous changes in the details of implementation of the invention can be made without departing from the spirit and scope of the invention. Features of the disclosed embodiments can be combined and rearranged in various ways.

What is claimed is:

1. An apparatus for a musical instrument, the apparatus comprising:

a pedalboard that receives an audio signal and that routes the audio signal through one or more instrument pedals such that the audio signal is modified based on one or more instrument effects from the one or more instrument pedals, wherein a top surface of the pedalboard includes:

a plurality of pedal attachment regions that receives the one or more instrument pedals, wherein each of the plurality of pedal attachment regions includes an adjustable slider that adjust to accommodate placement of an instrument pedal of differing dimensions, wherein the adjustable slider exposes a mating pin connector for connecting with a plurality of pins positioned on a rear surface of the instrument pedal, and wherein a communication channel between the instrument pedal and the pedalboard is created via a connection of the mating pin connector with the plurality of pins.

2. The apparatus of claim 1, wherein the audio signal is received from a musical instrument.

3. The apparatus of claim 1, wherein the mating pin connector is a spring-loaded connector.

4. The apparatus of claim 1, further comprising a power supply, wherein a first instrument pedal is connected to the pedalboard at a first pedal attachment region of the plurality of pedal attachment regions and a second instrument pedal is connected to the pedalboard at a second pedal attachment region of the plurality of pedal attachment regions, and wherein a first voltage from the power supply is provided to the first instrument pedal using a first group of the plurality of pins associated with the first instrument pedal and a second voltage from the power supply that is different than the first voltage is provided to the second instrument pedal using a second group of the plurality of pins associated with the second instrument pedal.

5. The apparatus of claim 1, wherein an instrument pedal of the one or more instrument pedals is configured to be in one of an active configuration or a bypass configuration, wherein the audio signal passes through and is modified by the instrument pedal when the instrument pedal is in the active configuration, and wherein the audio signal does not pass through the instrument pedal when the instrument pedal is in the bypass configuration and remains in the pedalboard.

6. The apparatus of claim 1, further comprising a plurality of light indicators, each light indicator of the plurality of light indicators corresponding to an instrument pedal of the one or more instrument pedals, wherein each light indicator indicates a status of a corresponding instrument pedal.

7. The apparatus of claim 1, further comprising a foot controller, wherein the foot controller is configured to change a configuration of a plurality of the one or more instrument pedals via circuitry in the pedalboard.

8. The apparatus of claim 1, wherein a portion of each of the plurality of pedal attachment regions is rotatable into a plurality of positions.

9. The apparatus of claim 1, further comprising a wireless communications adapter that opens the communication channel with an external device for transmitting information between the pedalboard apparatus and the external device over a wireless communications network.

10. The apparatus of claim 9, wherein the pedalboard apparatus receives a user input via the external device and transmits a signal corresponding to the user input to an instrument pedal of the one or more instrument pedals via the communication channel.

11. The apparatus of claim 9, wherein the pedalboard apparatus determines information associated with the instrument pedal via the communication channel and transmits the determined information to the external device.

12. The apparatus of claim 9, further comprising an adaptor that is configured to be attached to the pedalboard at a pedal attachment region of the plurality of pedal attachment regions at a first side of the adaptor, wherein the adaptor is configured to be attached to a second instrument pedal, wherein the second instrument pedal cannot be connected to the pedalboard at any of the plurality of pedal attachment regions, and wherein the adaptor is configured to accept one or more cables connected to corresponding jacks of the second instrument pedal.

13. A pedalboard for a musical instrument, the pedalboard comprising:

a hardware processor; and a plurality of pedal attachment regions connected to the hardware processor, wherein each of the plurality of pedal attachment regions receives an instrument pedal, wherein each of the plurality of pedal attachment regions includes an adjustable slider that adjust to accommodate the instrument pedal of differing dimensions, wherein the adjustable slider exposes a mating pin connector for connecting with a plurality of pins positioned on a surface of the instrument pedal, and wherein a communication channel between the instrument pedal and the hardware processor is created via a connection of the pin connector with the plurality of pins;

wherein the hardware processor is configured to receive an audio signal from the musical instrument and route the audio signal through the instrument pedal such that the audio signal is modified based on one or more instrument effects from the instrument pedal.

14. The pedalboard of claim 13, wherein the mating pin connector is a spring-loaded connector.

15. The pedalboard of claim 13, further comprising a power supply, wherein a first instrument pedal is connected to the pedalboard at a first pedal attachment region of the plurality of pedal attachment regions and a second instrument pedal is connected to the pedalboard at a second pedal attachment region of the plurality of pedal attachment regions, and wherein a first voltage from the power supply is provided to the first instrument pedal using a first group of the plurality of pins associated with the first instrument pedal and a second voltage from the power supply that is different than the first voltage is provided to the second instrument pedal using a second group of the plurality of pins associated with the second instrument pedal.

16. The pedalboard of claim 13, wherein the instrument pedal of the one or more instrument pedals is configured to be in one of an active configuration or a bypass configuration, wherein the audio signal passes through and is modified by the instrument pedal when the instrument pedal is in the active configuration, and wherein the audio signal does not pass through the instrument pedal when the instrument pedal is in the bypass configuration and remains in the pedalboard.

17. The pedalboard of claim 13, further comprising a plurality of light indicators, each light indicator of the plurality of light indicators corresponding to an instrument pedal of the one or more instrument pedals, wherein each light indicator indicates a status of a corresponding instrument pedal.

18. The pedalboard of claim 13, wherein a portion of each of the plurality of pedal attachment regions is rotatable into a plurality of positions.

19. The pedalboard of claim 13, further comprising an adaptor that is configured to be attached to the pedalboard at a pedal attachment region of the plurality of pedal attachment regions at a first side of the adaptor, wherein the adaptor is configured to be attached to a second instrument pedal, wherein the second instrument pedal cannot be connected to the pedalboard at any of the plurality of pedal attachment regions, and wherein the adaptor is configured to accept one or more cables connected to corresponding jacks of the second instrument pedal.

* * * * *